United States Patent [19]

Murphy

[11] 4,259,217

[45] Mar. 31, 1981

[54] LAUNDRY DETERGENT COMPOSITIONS HAVING ENHANCED GREASY AND OILY SOIL REMOVAL PERFORMANCE

[75] Inventor: Alan P. Murphy, Cincinnati, Ohio

[73] Assignee: The Procter & Gamble Company, Cincinnati, Ohio

[21] Appl. No.: 919,181

[22] Filed: Jun. 26, 1978

Related U.S. Application Data

[63] Continuation-in-part of Ser. No. 884,466, Mar. 7, 1978, abandoned, which is a continuation-in-part of Ser. No. 852,187, Nov. 16, 1977, abandoned, which is a continuation-in-part of Ser. No. 811,220, Jun. 29, 1977, abandoned.

[51] Int. Cl.[3] ..... C11D 1/38; C11D 7/32

[52] U.S. Cl. ..... 252/547; 252/174.21; 252/174.22; 252/528; 252/8.6; 252/8.8; 560/60; 560/155; 560/179; 560/190; 260/404; 564/282; 564/292; 564/294; 564/295

[58] Field of Search ..... 252/89, 547, 528, 8.8 R, 252/8.6, 174.21, 174.22; 560/190, 155, 179, 60; 260/404, 567.6 M, 567.6 R, 567.6 P

[56] References Cited

U.S. PATENT DOCUMENTS

| | | | |
|---|---|---|---|
| 2,950,253 | 8/1960 | Kling et al. | 252/152 |
| 3,322,676 | 5/1967 | Hlestand | 252/152 |
| 3,607,763 | 9/1971 | Salmen et al. | 252/152 |
| 3,703,480 | 11/1972 | Grand et al. | 252/547 |
| 3,749,674 | 7/1973 | Jones | 252/8.8 R |
| 3,862,045 | 1/1975 | Cato et al. | 252/547 |
| 3,904,359 | 9/1975 | Ramachanduan | 252/8.8 R |
| 3,904,533 | 9/1975 | Neidich | 252/8.8 R |
| 3,983,078 | 9/1975 | Collins | 252/89 R |

FOREIGN PATENT DOCUMENTS

| | | | |
|---|---|---|---|
| 662710 | 10/1968 | Belgium . | |
| 818419 | 7/1969 | Canada | 252/528 |
| 52-59606 | 5/1977 | Japan . | |

*Primary Examiner*—Mayer Weinblatt

*Attorney, Agent, or Firm*—Robert B. Aylor; Thomas H. O'Flaherty; Richard C. Witte

[57] ABSTRACT

Laundry detergent compositions containing no phosphate or low levels of phosphate materials and specific mixtures of selected nonionic surfactants and selected cationic surfactants are disclosed. The nonionic/cationic surfactant mixtures are formulated to have "cloud point" characteristics and, preferably, reduced cationic monomer concentrations as defined herein. These compositions are unusually effective in removing greasy and oily soils and body soils from fabrics; they are also effective in the removal of particulate soils. A process is disclosed for laundering fabrics using compositions containing nonionic surfactants and cationic surfactants.

37 Claims, No Drawings

LAUNDRY DETERGENT COMPOSITIONS HAVING ENHANCED GREASY AND OILY SOIL REMOVAL PERFORMANCE

CROSS REFERENCE TO RELATED APPLICATION

This application is a continuation-in-part of copending application, Ser. No. 884,466, Alan Pearce Murphy, filed Mar. 7, 1978, which is a continuation-in-part of copending application Ser. No. 852,187, Alan Pearce Murphy, filed Nov. 16, 1977, which is a continuation-in-part of copending application Ser. No. 811,220, Alan Pearce Murphy, filed June 29, 1977 for LAUNDRY DETERGENT COMPOSITIONS HAVING ENHANCED GREASY AND OILY SOIL REMOVAL PERFFORMANCE. All of said applications are now abandoned.

TECHNICAL FIELD

This invention relates to laundry detergent compositions which exhibit highly improved greasy and oily soil and body soil removal capabilities. The compositions may be free of phosphate; alternatively, they may contain low levels of phosphate materials but not amounts in excess of about 20% by weight. These detergent compositions provide an unexpectedly high level of greasy and oily soil (such as motor oil, triolein, animal fat and lipstick) removal; they also provide excellent removal of particulate soils, expecially clay soils, as well as fabric care benefits, such as fabric softening, static control, and dye transfer inhibition. Similar compositions, which utilize mixtures of selected nonionic surfactants and selected cationic surfactants and give an unexpectedly high level of particulate soil removal performance, are described in concurrently filed U.S. patent application Ser. No. 919,341, Cockrell, which is a continuation-in-part of U.S. patent application Ser. No. 852,428, filed Nov. 11, 1977, which is a continuation-in-part of U.S. patent application Ser. No. 811,221, filed June 29, 1977, all of which are incorporated herein by reference, and are now abandoned.

BACKGROUND ART

Nonionic surfactants are generally included in laundry detergent compositions for their ability to attack greasy and oily soils. Cationic surfactants are also used in detergent compositions primarily to provide adjunct fabric care benefits and not for the purpose of enhancing cleaning. Certain cationic surfactants provide a germicidal or sanitization benefit to washed surfaces; see for example, U.S. Pat. No. 2,742,434, Koop, issued Apr. 17, 1956; U.S. Pat. No. 3,539,520, Cantor et al, issued Nov. 10, 1970; and U.S. Pat. No. 3,965,026, Lancz, issued June 22, 1976. Other cationic surfactants, such as ditallowalkyldimethylammonium chloride, are included in detergent compositions to provide a fabric softening benefit, as disclosed in U.S. Pat. No. 3,607,763, Salmem et al, issued Sept. 21, 1971; and U.S. Pat. No. 3,644,203, Lamberti et al, issued Feb. 22, 1972. Such components are also used to control static, as well as to soften laundered fabrics as, for example, in U.S. Pat. No. 3,951,879, Wixon, issued Apr. 20, 1976; and U.S. Pat. No. 3,959,157, Inamorato, issued May 25, 1976. All of such patents being incorporated herein by reference.

The compositions of the present invention have outstanding cleaning capabilities. In full scale laundry tests, these compositions have been shown to be three to four times as effective in removing some typical greasy and oily soils than conventional laundry detergents, including commercially-available heavy duty liquid detergents containing a high proportion of nonionic surfactants. These same detergent compositions, with or without phosphate or other builder components, are also effective in removing clay soils at least as well, and in some instances, substantially better than fully-built conventional granular laundry detergent compositions, and, in addition provide a range of fabric care benefits, such as fabric softening, static control and dye transfer inhibition, to the laundered fabrics. Thus, the compositions of the present invention provide the user with a well-rounded cleaning and fabric care package. These results, which are vastly superior to those previously demonstrated, particularly in the removal of greasy and oily soils, are the result of a heretofore unrecognized cleaning potential of certain selected cationic surfactants when used in the presence of certain selected nonionic surfactants in accordance with the cloud point requirement, and preferably the reduced cationic monomer concentration definition specified herein.

It is an object of this invention to provide laundry detergent compositions which yield outstanding greasy and oily soil and body soil removal.

It is another object of this invention to provide laundry detergent compositions which have excellent particulate soil removal performance and fabric conditioning benefits, in addition to outstanding greasy and oily soil and body soil removal performance, in the presence or absence of builder components.

It is a further object of this invention to provide detergent compositions which may be used in a variety of physical forms, such as liquid, paste, granular, solid, powder, or in conjunction with a carrier such as a substrate.

It is a still further object of this invention to provide a process for laundering fabrics to remove greasy and oily soil and body soil, as well as particulate soil, using cationic and nonionic surfactant-containing detergent compositions.

DISCLOSURE OF THE INVENTION

The present invention relates to phosphate-free laundry detergent compositions or, alternatively, compositions which contain levels of phosphate which are no greater than about 20%, by weight, that comprise from about 5 to 100%, by weight, of a surfactant mixture consisting essentially of:

(a) a biodegradable nonionic surfactant having the formula $R(OC_2H_4)_nOH$ wherein R is a primary or secondary alkyl chain of from about 8 to about 22 carbon atoms and n is an average of from about 2 to about 12, and having an HLB of from about 5 to about 17; and (b) a cationic surfactant, free of hydrazinium groups, having the formula $R_m^1R_x^2Y_LZ$ wherein each $R^1$ is an organic group containing a straight or branched alkyl or alkenyl group optionally substituted with up to 3 phenyl or hydroxy groups and optionally interrupted by up to 4 structures from the group consisting of

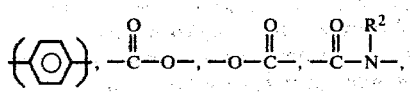

-continued

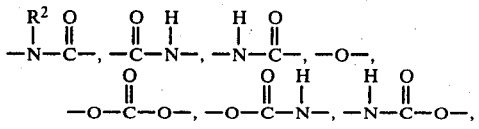

and mixtures thereof, each $R^1$ containing from about 8 to about 22 carbon atoms, and which may additionally contain up to about 12 ethylene oxide groups; m is a number from 1 to 3; each $R^2$ is an alkyl or hydroxy alkyl group containing from 1 to 4 carbon atoms or a benzyl group, with no more than one $R^2$ in a molecule being benzyl; x is from 0 to 11, the remainder of any carbon atom positions being filled by hydrogens; Y is selected from the group consisting of (1)

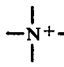

(2)

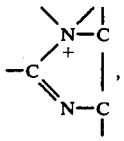

(3)

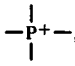

(4)

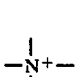

(5)

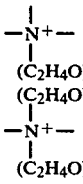

, wherein p is from 1 to 12, (6)

, wherein each p is from 1 to 12, (7)

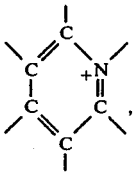

(8)

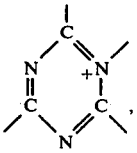

, and mixtures thereof;

(9)

L is 1 or 2, the Y groups being separated by a moiety selected from the group consisting of $R^1$ and $R^2$ analogs having from one to about twenty-two carbon atoms and 2 free carbon single bonds when L is 2, Z is an anion in a number sufficient to give electrical neutrality, said cationic surfactant being at least water-dispersible in admixture with said nonionic surfactant;

said composition having a pH of at least about 6.5 in the aqueous laundry solution, and being substantially free of oily hydrocarbon materials and cationic materials containing about 13 or more ethylene oxide groups, the ratio of said nonionic to said cationic surfactant being in the range of from 5.1:1 to about 100:1, and the "cloud point", as described hereinafter, of said surfactant mixture being from about 0 to about 95° C. Preferred compositions are those in which the reduced cationic monomer concentration of said surfactant mixture is from about 0.002 to about 0.2.

The compositions of the present invention are formulated so as to have a pH of at least about 6.5, preferably greater than about 7 in the laundry solution at conventional usage concentrations in order to optimize cleaning performance on greasy and oily soils; acidic wash solution pH's tend to decrease performance on such soils. Preferably, the compositions are alkaline in nature when placed in the laundry solution, and have a pH of greater than about 7.5, particularly at least about 8. Some of the cationic/nonionic systems of the present invention will attain optimum removal of greasy/oily soils at these higher pHs. In such systems, overall performance may be improved by varying the wash solution pH during the laundering process.

The compositions are free of oily hydrocarbon materials, such as many dry cleaning solvents, mineral oil, paraffin oil and kerosene, because these materials (which are themselves oily in nature) load the washing liquor with excessive oily material, thereby diminishing the cleaning effectiveness of the compositions of this invention.

The cationic component is free of hydrazinium groups due to their relatively high toxicity level which makes them unsuitable for use in the compositions of this invention.

Preferred compositions contain nonionic surfactant to cationic surfactant ratios of from 5.1:1 to about 50:1, preferably from about 6:1 to about 40:1, particularly from about 6:1 to about 20:1. Greasy and oily soil removal is greatly enhanced at ratios between about 8:1 to about 20:1, the improvement in performance generally being most noticeable as the amount of nonionic is increased so that the ratio of nonionic to cationic surfactant becomes greater than 5.1:1 and approaches 8:1.

There is no sharp line of delineation in cleaning performance between the compositions of the present invention and those described in U.S. patent application Ser. No. 919,341, Cockrell, when the ratio of nonionic to cationic surfactant is at or about 5:1. The cleaning benefits of both inventions can be obtained when such ratios are used. The greasy and oily soil removal benefits of the present invention are best appreciated at ratios of nonionic to cationic surfactant which are in excess of 5:1, namely 5.1:1 and especially at 8:1 and above. Thus, a clear line of distinction is maintained between the two inventions.

Preferred compositions may contain mixed cationic and/or mixed nonionic surfactant systems. The cationic surfactants should all be within the definition of the cationic surfactants set forth above although small amounts of other cationic materials can be tolerated. The mixed nonionic surfactant systems may contain nonionic surfactants which fall outside of the definition given above (such as alcohol ethoxylates having an average of greater than 12 ethylene oxide groups per molecule) as long as at least one of the nonionic surfactants in the mixture falls within the definition of the nonionic surfactants, and that nonionic surfactant is included in an amount so as to fall within the required ratio of nonionic to cationic surfactants. When the nonionic surfactant mixture contains a nonionic surfactant (or surfactants) which falls outside of the definition of nonionic surfactants, the ratio of the surfactant (or surfactants) within the above definition to that which does not fall within the definition preferably is in the range of from about 1:1 to about 5:1.

The compositions of the present invention comprise, by weight, from about 5 to 100%, particularly from about 10 to about 95%, and most preferably from about 20 to about 90% of a mixture of the particularly defined nonionic and cationic surfactants in the ratios stated. It is preferred that the detergent compositions contain at least about 1% of the cationic component; otherwise, sufficient cationic surfactant may not be present in the wash solution to provide the desired cleaning and conditioning results. Further, preferred compositions do not contain more than about 10% of the cationic component, due to cost and commercial availability considerations.

Compositions of the present invention may contain up to about 60% of an electrolyte (although low levels of from about 1 to 20% are preferred), such as a detergency builder, as well as other adjunct components conventionally found in laundry detergent components, as more fully explained hereinafter. The compositions may be phosphate-free, although low levels of a phosphate builer which are less than 20% of the total composition, by weight, can be tolerated. It is preferred that the compositions be phosphate-free for environmental purposes. To the extent that phosphate or other electrolytes are present in these compositions, they act primarily to affect cleaning performance by modifying the cloud point temperature of the nonionic/cationic surfactant mixture, as described hereinafter.

The primary use of the compositions of the present invention is in conventional home laundry operations. The compositions may also be used for other detergency purposes, including the pretreatment of greasy and oily spots and in industrial laundry operations.

Processes for laundering fabrics with the compositions of the present invention, which provide superior greasy and oily soil removal and fabric care benefits, are taught herein. In these processes, the laundry detergent compositions are used under temperature conditions such that the aqueous laundry solution is either at, or close to (i.e.,within about 20° C. of ) the cloud point (i.e., the temperature at which a phase rich in nonionic surfactant separates in the laundry solution) of the nonionic/cationic surfactant mixture. This can preferably be accomplished by formulating those nonionic/cationic surfactant mixtures so that their cloud point falls between about 0 and 95° C., particularly from about 10 to 70° C., especially between about 20° and 70° C., most especially from about 30 to about 50° C. During the washing operation, the temperature of the laundry solution is held within this temperature range and within 20° C. of the cloud point temperature. Performance is improved further where the temperaure of the aqueous laundry solution is within about 15° C., more preferably within about 10° C., of the nonionic/cationic surfactant mixture cloud point temperature.

Nonionic Component

The nonionic surfactants used in the compositions of the present invention are biodegradable and have the formula $R(OC_2H_4)_nOH$, wherein R is a primary, or secondary alkyl chain of from about 8 to about 22, preferably from about 10 to 20, carbon atoms and n is an average of about 2 to about 12, particularly from about 2 to about 9. The ionic surfactants included within the present invention include branched alcohol ethoxylates. Although primarily linear alcohol ethoxylates (e.g., alcohol ethoxylates produced from organic alcohols which contain about 20% 2-methyl branched isomers, commercially available from Shell Chemical Company under the tradename Neodol) are preferred from a performance viewpoint, it is possible, using secondary alcohol ethoxylates, to formulate compositions which give both optimum clay and grease/oil removal at about the same nonionic:cationic ratio (nonionic:cationic ratio equals from 5.1:1 to about 15:1). However, compositions which utilize these secondary alcohol ethoxylates tend to require higher usage concentrations, in the laundry solution in order to achieve their best performance, than do compositions which include primary alcohol ethoxylates.

The nonionics have an HLB (hydrophilic-lipophilic balance) of from about 5 to about 17, preferably from about 6 to about 15. Optimum grease/oil removal is achieved where the nonionic surfactant has an HLB of from about 9 to about 13, particularly from about 10 to about 12. In such compositions, for optimum grease/oil removal, it is preferred to use cationic surfactants which are relatively soluble, such as mono-long chain (e.g., $C_{10}$–$C_{18}$ alkyl) quaternary ammonium compounds or quaternary ammonium compounds which contain a total of no more than about 28 carbon atoms in their $R^1$ and $R^2$ moieties. HLB is defined in detail in *Nonionic Surfactants* by M. J. Schick, Marcel Dekker, Inc., 1966, pp. 607–613, incorporated herein by reference. In preferred nonionic surfactants, n is from 2 to 7, most preferably from 4 to 7.

Nonionic surfactants which are within the definition of the nonionic component include a secondary $C_{15}$ alcohol polyethoxylate containing an average of 5 moles of ethylene oxide, a $C_{12}$ alcohol polyethoxylate containing an average of 5 moles of ethylene oxide, a $C_{10}$ alcohol polyethoxylate containing an average of 4 moles of ethylene oxide, a $C_{14}$ alcohol polyethoxylate containing an average of 4 moles of ethylene oxide. This last surfactant is particularly useful for cold water laundering of fabrics. Preferred nonionic surfactants useful in the compositions of the present invention include a $C_{10}$ alcohol polyethoxylate containing an average of 3 moles of ethylene oxide, a $C_{12-13}$ alcohol polyethoxylate containing an average of 3 moles of ethylene oxide, and the same product which is stripped to remove substantially all lower ethoxylate and nonethoxylated fractions, a $C_{14-15}$ alcohol polyethoxylate containing an average of 7 moles of ethylene oxide, a $C_{12-13}$ alcohol polyethoxylate containing an average of 6.5 moles of ethylene oxide, a $C_{12}$ alcohol polyethoxylate containing an average of 5 moles of ethylene oxide, a coconut alcohol polyethoxylate containing an average of 5 moles of ethylene oxide, a $C_{12-13}$ alcohol polyethoxylate containing an average of 9 moles of ethylene oxide, a $C_{14-15}$ alcohol polyethoxylate containing an average of 3 moles of ethylene oxide, a $C_{14-15}$ alcohol polyethoxylate containing an average of 4 moles of ethylene oxide, and a $C_{14-15}$ alcohol polyethoxylate containing an average of 9 moles of ethylene oxide.

Specific examples of nonionic surfactant mixtures in which both components are within the definition of the nonionic component include: a mixture of a $C_{14-15}$ alcohol polyethoxylate containing an average of 3 moles of ethylene oxide (Neodol 45-3) and a $C_{14-15}$ alcohol polyethoxylate containing an average of 7 moles of ethylene oxide (Neodol 45-7), in a ratio of lower ethoxylate nonionic to higher ethoxylate nonionic of from about 1:1 to about 3:1, a mixture of a $C_{10}$ alcohol polyethoxylate containing an average of 3 moles of ethylene oxide together with a secondary $C_{15}$ alcohol polyethoxylate containing an average of 9 moles of ethylene oxide (Tergitol 15-S-9), in a ratio of lower ethoxylate nonionic to higher ethoxylate nonionic of from about 1:1 to about 4:1, and a mixture of Neodol 45-3 and Tergitol 15-S-9, in a ratio of lower ethoxylate nonionic to higher ethoxylate nonionic of from about 1:1 to about 3:1.

Preferred nonionic surfactant mixtures contain alkyl glyceryl ether compounds in addition to the required nonionic surfactant. Especially preferred glyceryl ethers have the formulae $$R-OCH_2-\underset{\underset{OH}{|}}{CH}-CH_2OH \text{ and } R-O(CH_2CH_2O)_nCH_2\underset{\underset{OH}{|}}{CH}CH_2OH$$

wherein R is an alkyl or alkenyl group of from about 8 to about 18, preferably 8 to 12, carbon atoms or an alkaryl group having from about 5 to 14 carbon atoms in the alkyl chain, and n is from 1 to about 6. These materials are used in compositions with the nonionic surfactant component of the present invention in the ratio of nonionic surfactant to glyceryl ether of from about 1:1 to about 4:1, particularly about 7:3. Glyceryl ethers of the type useful in the present invention are disclosed in U.S. patent application Ser. No. 644,214, Jones, filed Dec. 24, 1975, now abandoned; and U.S. pat. application Ser. No. 735,647, Jones, filed Oct. 26, 1976, now U.S. Pat. No. 4,098,713; both of which are incorporated herein by reference.

A preferred group on nonionic surfactants useful herein comprise a mixture of "surfactant" and "cosurfactant", containing at least one nonionic surfactant falling within the definition of nonionic surfactants useful in the present invention, as described in U.S. patent application Ser. No. 730,499, Collins, filed Oct. 7, 1976, the disclosure of which is incorporated herein by reference.

Preferred compositions of the present invention are substantially free of fatty acid polyglycol ether di-ester compounds, such as polyethylene glycol-600-dioleate or polyethylene glycol-800-distearate. Such additives offer no advantage, and possibly even result in a disadvantage in terms of achieving the soil removal and fabric conditioning potential of the present invention.

Other nonionic surfactants well known in the detergency arts may be used, in combination with one or more of the nonionic surfactants falling within the definition of nonionic surfactants useful in the present invention, to form useful nonionic surfactant mixtures. Examples of such surfactants are listed in U.S. Pat. No. 3,717,630, Booth, issued Feb. 20, 1973, and U.S. Pat. No. 3,332,180, Kessler et al, issued July 25, 1967, each of which is incorporated herein by reference. Nonlimiting examples of suitable nonionic surfactants which may be used in conjunction with the required nonionic surfactants defined above include the condensation products of aliphatic alcohols with ethylene oxide, which differ in terms of alkyl or ethylene oxide chain length (e.g., more than twelve ethylene oxide groups per molecule) so as to fall outside the definition, given above.

These supplemental nonionic surfactants may also be of the semi-polar type, including water-soluble amine oxides containing one alkyl moiety of from about 10 to 28 carbon atoms and two moieties selected from the group consisting of alkyl groups and hydroxyalkyl groups. A preferred amine oxide is $C_{12-14}$ alkyl dimethyl amine oxide. In addition to their surface-active properties, these compounds may also be included, in amounts of from about 3 to about 20% of the composition, so as to modify the sudsing properties of the detergent compositions, to make them compatible with particular types of laundering conditions. Other semi-polar surfactants include water-soluble phosphine oxides containing one alkyl moiety of about 10 to 28 carbon atoms and two moieties selected from the group consisting of alkyl groups and hydroxyalkyl groups containing from about 1 to 3 carbon atoms, and water-soluble sulfoxides containing one alkyl moiety of from about 10 to 28 carbon atoms and a moiety selected from the group consisting of alkyl and hydroxyalkyl moieties of from 1 to 3 carbon atoms.

Cationic Component

The cationic surfactants used in the compositions of the present invention have the formula $R_m{}^1R_x{}^2Y_LZ$ wherein each $R^1$ is an organic group containing a straight or branched alkyl or alkenyl group optionally substituted with up to three phenyl or hydroxyl groups, and optionally interrupted by up to four structures selected from the group consisting of:

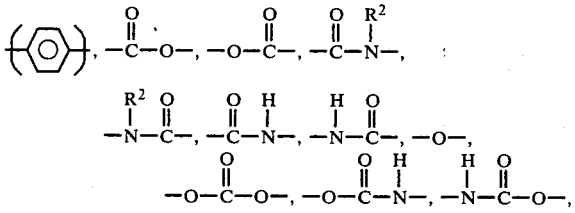

and mixtures thereof, and which contains from about 8 to 22 carbon atoms, and which may additionally contain up to 12 ethylene oxide groups, and m is a number from 1 to 3. $R^2$ is an alkyl or hydroxy alkyl group containing from 1 to 4 carbon atoms, or a benzyl group with no more than one $R^2$ in a molecule being benzyl, and x is a number from 0 to 11, preferably from 0 to 6. The remainder of any carbon positions on the Y group are filled by hydrogens. Y is selected from the group consisting of:

(1)

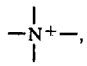

(2)

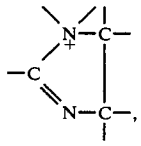

(3)

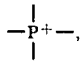

(4)

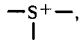

-continued (5)

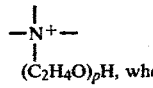

$(C_2H_4O)_pH$, wherein p is from 1 to 12, (6)

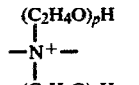

$(C_2H_4O)_pH$, wherein each p is from 1 to 12, (7)

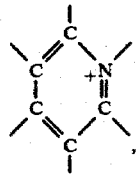

(8)

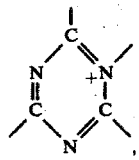

, and (9) mixtures thereof;

L is 1 or 2, with the Y groups being separated by a moiety selected from the group consisting of $R^1$ and $R^2$ analogs (preferably alkylene or alkenylene) having from one to about twenty-two carbon atoms and 2 free carbon single bonds when L is 2. Z is a water-soluble anion such as halide, methyl sulfate, sulfate, or nitrate anion, particularly preferred anions being chloride, bromide, iodide, sulfate, or methyl sulfate, in a number to give electrical neutrality of the cationic component.

The particular cationic component to be included in a given system depends to a large extent upon the particular nonionic component to be used; it is selected such that it is at least water-dispersible when mixed with the nonionic surfactant. The cationic surfactant is chosen, in light of the particular nonionic surfactant used, in order to satisfy the cloud point requirements of the detergent composition, discussed below. Mixtures of these cationic materials may also be used in the compositions of the present invention. Preferred cationic surfactants are those having critical micelle concentrations of less than about 500 ppm, especially less than about 100 ppm.

In preferred cationic materials, L is equal to 1, p is from 1 to 12, preferably from 1 to 10, and Y is

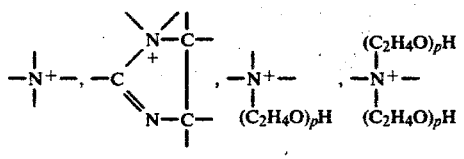

or mixtures thereof. However, L may be equal to two, thereby yielding cationic components containing two cationic charge centers. An example of a di-cationic component is given below:

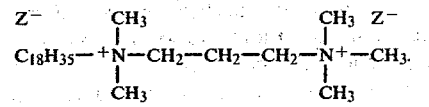

Other cationic materials which are useful in the compositions of the present invention include phosphonium and sulfonium materials.

In preferred cationic materials, described above, where m is equal to 1, it is preferred that x is equal to 3, and $R^2$ is a methyl group. Preferred compositions of this mono-long chain type include those in which $R^1$ is a $C_{10}$ to $C_{18}$ alkyl group. Particularly preferred components of this class include $C_{16}$ (palmitylalkyl) trimethylammonium halide, tallowalkyl trimethylammonium halide and coconutalkyl trimethylammonium halide. In preferred systems, tallowalkyl trimethylammonium or coconutalkyl trimethyammonium materials are combined with a nonionic surfactant selected from the condensation products of $C_{12}$–$C_{13}$ alcohol with 4 to 10 moles of ethylene oxide or the condensation product of $C_{14}$–$C_{15}$ alcohol with 6 to 10 moles of ethylene oxide, such as the condensation product of $C_{12}$ alcohol with 5 moles of ethylene oxide, the condensation product of $C_{12-13}$ alcohol with 6.5 moles of ethylene oxide, the condensation product of $C_{14-15}$ alcohol with 7 moles of ethylene oxide, or mixtures thereof, in nonionic: cationic ratios of from 5.1:1 to about 30:1, particularly from about 7:1 to about 20:1, most preferably about 10:1. In addition to outstanding grease/oil removal, excellent particulate removal is obtained using the condensation product of $C_{12}$—$C_{14}$ alcohol with 2 to 4 moles of ethylene oxide or the condensation product of $C_{14}$–$C_{15}$ alcohol with 3–6 moles of ethylene oxide, in nonionic/cationic ratios of from 5.1:1 to about 10:1. These compositions may also contain up to about 15% of alkanolamine, preferably monoethanolamine, as an alkalinity source and to increase body soil removal. For example, coconutalkyl trimethylammonium chloride may be combined with the condensation product of $C_{12}$ alcohol with 5 moles of ethylene oxide, the condensation product of $C_{12-13}$ alcohol with 6.5 moles of ethylene oxide, or mixtures thereof, in nonionic:cationic ratios of from 5.1:1 to about 20:1, especially 5.1:1 to about 9:1. In another composition, coconutalkyl trimethylammonium chloride is combined with the condensation product of $C_{14-15}$ alcohol with 7 moles of ethylene oxide, in nonionic:cationic ratios of from 5.1:1 to about 15:1.

Another preferred composition utilizes cationic surfactants of the formula

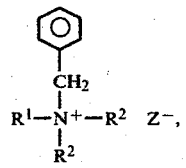

wherein $R^1$, $R^2$ and Z are as defined above, in combination with the condensation product $C_{12}$–$C_{13}$ alcohols with 5 to 10 moles of ethylene oxide or the condensation product of $C_{14}$–$C_{15}$ alcohol with 5 to 10 moles of ethylene oxide, such as the condensation product of $C_{12}$ alcohol with 5 moles of ethylene oxide, the condensation product of $C_{12-13}$ alcohol with 6.5 moles of ethylene oxide, the condensation product of $C_{14-15}$ alcohol with 7 moles of ethylene oxide, and mixtures thereof, in nonionic:cationic ratios of from 5.1:1 to about 15:1, particularly about 7:1.

Where m is equal to 2 it is preferred that x is equal to 2, and that $R^2$ is a methyl group. In this instance it is also preferred that $R^1$ is a $C_{10}$ to $C_{20}$ alkyl group. Particularly preferred cationic materials of the class include dicoconutalkyl ($C_{12}$–$C_{14}$) dimethylammonium halide, distearylakyl ($C_{18}$) dimethylammonium halide and ditallowalkyl ($C_{16}$–$C_{18}$) dimethylammonium halide materials. Preferred compounds of this type utilize dicoconutalkyl dimethylammonium halide together with the condensation product of $C_{12}$–$C_{13}$ alcohol with 6 to 10 moles of ethylene oxide or the condensation product of $C_{14}$–$C_{15}$ alcohol with 5 to 9 moles of ethylene oxide, such as the condensation product of $C_{12-13}$ alcohol with 6.5 moles of ethylene oxide, the condensation product of $C_{14-15}$ alcohol with 7 moles of ethylene oxide, and mixtures thereof, in nonionic:cationic ratios of from 5.1:1 to about 15:1, especially from about 6:1 to about 12:1. Outstanding removal of particulate soils, in addition to excellent greasy/oily soil removal, may be obtained using the condensation product of $C_{12}$–$C_{13}$ alcohol with 4 to 8 moles of ethylene oxide or the condensation product of $C_{14}$–$C_{15}$ alcohol with 4 to 8 moles of ethylene oxide, in nonionic/cationic ratios of 5.1:1 to about 15:1.

Where tri-long chain materials are used (m=3), it is preferred that x is equal to 1 and that $R^2$ is a methyl group. In these compositions it is preferred that $R^1$ is a $C_8$ to $C_{11}$ alkyl group. Particularly preferred tri-long chain cationic materials include trioctylalkyl ($C_8$) methyl ammonium halide and tridecylalkyl ($C_{10}$) methyl ammonium halide.

Another preferred type of cationic surfactant useful in the compositions of the present invention is of the imidazolinium variety. A particularly preferred surfactant of this type is one having the structural formula

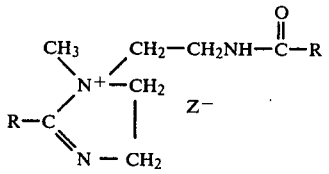

wherein R is $C_{10}$ to $C_{20}$ alkyl, particularly $C_{14}$ to $C_{20}$ alkyl. These imidazolinium surfactants may be used alone as the cationic component in the compositions of the present invention, or may be used in mixtures, together with other cationic surfactants, such as those described above. In these mixtures, it is preferred that the ratio of the imidazolinium surfactant to the other cationic surfactants is from about 4:1 to about 1:4. Particularly preferred mixtures of this type include the imidazolinium surfactant, shown above, together with palmitylalkyl trimethylammonium chloride or coconutalkyl trimethylammonium chloride or a mixture of coconutalkyl trimethylammonium chloride and palmitylalkyl trimethylammonium chloride.

Another type of preferred cationic surfactant for use in the compositions of the present invention are the alkoxylated alkyl quaternaries. Examples of such compounds are given below:

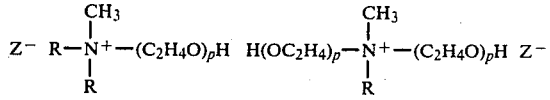

wherein each p is from 1 to 12, preferably from 1 to 10 (with the total ethylene oxide groups in a molecule not exceeding about 13), and each R is a $C_{10}$ to $C_{20}$ alkyl group. It is preferred that these compounds contain no more than a total of about 10, preferably no more than about 7, ethylene oxide groups in order to obtain the best removal of greasy and oily soils.

The compounds of the present invention must be substantially free of cationic compounds containing about 13 or more ethylene oxide groups. These compounds tend to be relatively non-biodegradable, do not enhance the cleaning or fabric conditioning benefits provided by the compositions and may, in some circumstances, decrease the overall laundering performance provided by them. It is to be noted that polyethoxylated cationic surfactants having relatively low levels of ethoxylation, such as those described above, exhibit better biodegradability characteristics and may be advantageously included in the compositions of the present invention.

A particularly preferred type of cationic component, which is described in U.S. patent application Ser. No. 919,344, Letton, filed of even date, which is a continuation-in-part of U.S. patent application Ser. No. 811,218, Letton, filed June 19, 1977, now abandoned, both of which are incorporated herein by reference, has the formula:

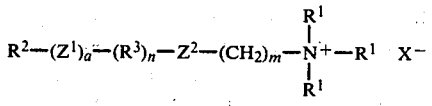

wherein $R^1$ is $C_1$ to $C_4$ alkyl or hydroxyalkyl; $R^2$ is $C_5$ to $C_{30}$ straight or branched chain alkyl, alkenyl, alkyl phenyl, or

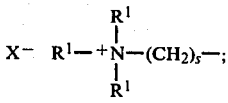

wherein s is from 0 to 5; $R^3$ is $C_1$ to $C_{20}$ alkylene or alkenylene; a is 0 to 1, n is 0 or 1, and n is 1 when a is 1; m is from 1 to 5; $Z^1$ and $Z^2$ are each selected from the group consisting of

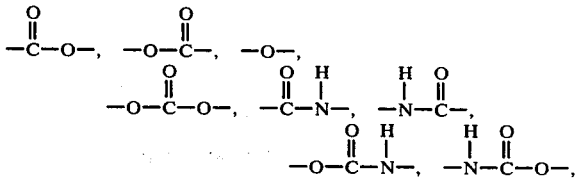

and wherein at least one of said groups is an ester, reverse ester, amide or reverse amide; and X is an anion which makes the compound at least water-dispersible, preferably selected from the group consisting of halide, methyl sulfate, sulfate, and nitrate, more preferably chloride, bromide, iodide, methyl sulfate and sulfate.

In addition to the advantages of the other cationic surfactants disclosed herein, this particular catonic component is environmentally desirable, since it is biodegradable, yielding environmentally acceptable compounds, both in terms of its long alkyl chain and its nitrogen-containing segment. These preferred cationic components are useful in nonionic/cationic surfactant mixtures which have a ratio of nonionic to cationic of from about 1:1 to about 100:1. However, when used in the compositions of the present invention they are used in surfactant mixtures which have nonionic to cationic surfactant ratios of from 5.1:1 to about 100:1, particularly from 5.1:1 to about 50:1, most preferably from about 6:1 to 40:1, especially from about 6:1 to about 20:1. These preferred cationic surfactants may also be used, to obtain outstanding particulate soil removal and fabric conditioning benefits, in the detergent system defined in U.S. application Ser. No. 919,341, Cockrell, filed of even date, incorporated herein by reference, in nonionic to cationic surfactant ratios of from 5:1 to about 1:1.

Particularly preferred cationic surfactants of this type are the choline ester derivatives having the following formula:

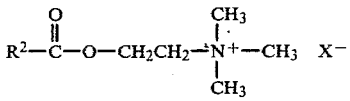

as well as those compounds in which the ester linkage in the above formula is replaced with a reverse ester, amide or reverse amide linkage.

Particularly preferred examples of this type of cationic surfactant include stearoyl choline ester quanternary ammonium halides ($R^2=C_{17}$ alkyl), palmitoyl choline ester quaternary ammonium halides ($R^2=C_{15}$ alkyl), myristoyl choline ester quaternary ammonium halides ($R^2=C_{11}$ alkyl), and tallowyl choline ester quaternary ammonium halides ($R^2=C_{15}$–$C_{17}$ alkyl).

Additional preferred cationic components of the choline ester variety are given by the structural formulas below, wherein p may be from 0 to 20.

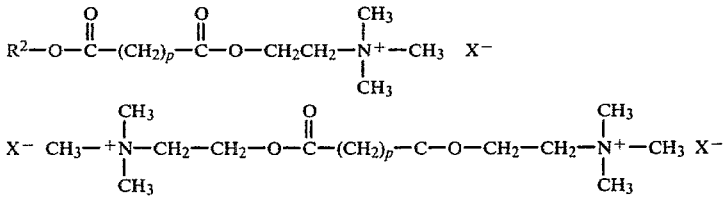

The preferred choline-derivative cationic substances, discussed above, may be prepared by the direct esterification of a fatty acid of the desired chain length with dimethylaminoethanol, in the presence of an acid catalyst. The reaction product is then quaternized with a methyl halide, forming the desired cationic material. The choline-derived cationic materials may also be prepared by the direct esterification of a long chain fatty acid of the desired chain length together with 2-haloethanol, in the presence of an acid catalyst material. The reaction product is then used to quaternize trimethylamine, forming the desired cationic component.

Another type of novel, particularly preferred cationic material, described in U.S. patent application Ser. No. 919,343, Letton, filed of even date, which is a continuation-in-part of U.S. patent application Ser. No. 811,219, Letton, filed June 29, 1977, now abandoned, both of which are incorporated herein by reference, has the formula:

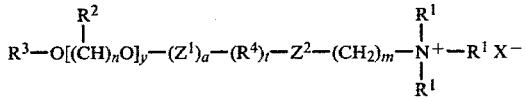

In the above formula, each $R^1$ is a $C_1$ to $C_4$ alkyl or hydroxyalkyl group, preferably a methyl group. Each $R^2$ is either hydrogen or $C_1$ to $C_3$ alkyl, preferably hydrogen. $R^3$ is a $C_4$ to $C_{30}$ straight or branched chain alkyl, alkenyl, or alkylbenzyl group, preferably a $C_8$ to $C_{18}$ alkyl group, most preferably a $C_{12}$ alkyl group. $R^4$ is a $C_1$ to $C_{10}$ alkylene or alkenylene group. n is from 2 to 4, preferably 2; y is from 1 to 20, preferably from about 1 to 10, most preferably about 7; a may be 0 or 1, and t may be 0 or 1, but t is 1 when a is 1; and m is from 1 to 5, preferably 2. $Z^2$ is selected from the group consisting

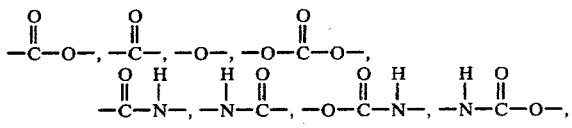

$Z^1$ is selected from the group consisting of:

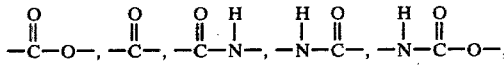

and at least one of $Z^1$ and $Z^2$ groups is selected from the group consisting of ester, reverse ester, amide or reverse amide. X is an anion which makes the compound at least water dispersible, and is selected from the group consisting of halides, methyl sulfate, sulfate, and nitrate, particularly chloride, bromide iodide, methyl sulfate and sulfate. Mixtures of the above structures can also be used.

These novel cationic surfactants may be used in nonionic/cationic surfactant mixtures in a ratio of nonionic surfactant to cationic surfactant of from about 1:1 to about 100:1. When these surfactants are used in the compositions of the present invention they are used in nonionic to cationic ratios of from 5.1:1 to about 100:1, preferably from 5.1:1 to about 50:1, most preferably from about 6:1 to about 40:1, especially from about 6:1 to about 20:1. They may also be used, to obtain outstanding removal of particulate soils, in the nonionic/cationic surfactant mixtures disclosed in U.S. patent application Ser. No. 919,341, Cockrell, filed of even date, wherein the ratio of nonionic surfactant to cationic surfactant would be from about 1:1 to 5:1. These surfactants, when used in the compositions of the present invention, yield excellent particulate soil, body soil, and greasy and oily soil removal. In addition, the detergent compositions control static and soften fabrics laundered therewith, and inhibit the transfer of dyes in the wash solution. Further, these novel cationic surfactants are environmentally desirable, since both their long chain alkyl segments and their nitrogen segments are biodegradable.

Preferred embodiments of this type of cationic component are esters in which ($R^1$ is a methyl group and $Z^2$ is an ester or reverse ester group. Particular examples of these compounds are given below, in which t is 0 or 1 and y is from 1 to 20.

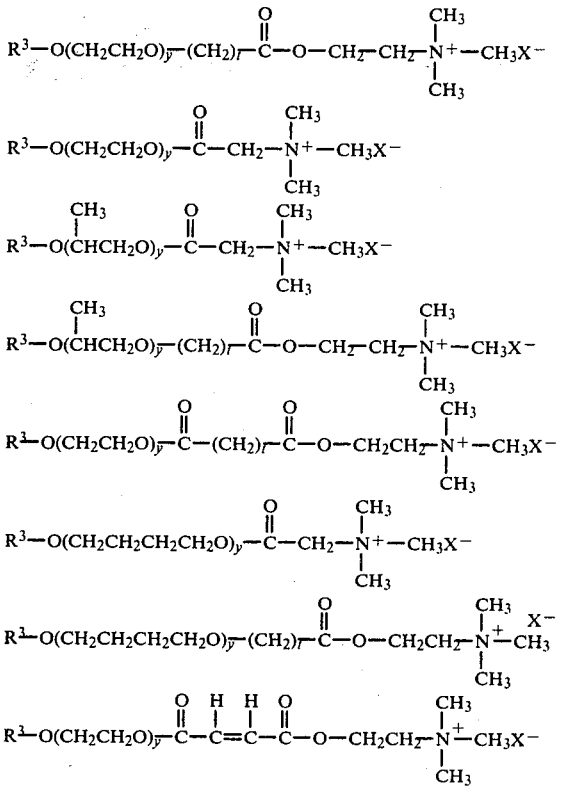

The preferred derivatives, described above, may be prepared by the reaction of a long chain alkyl polyalkoxy (preferably polyethoxy) carboxylate, having an alkyl chain of desired length, with oxalyl chloride, to form the corresponding acid chloride. The acid chloride is then reacted with dimethylaminoethanol to form the appropriate amine ester, which is then quaternized with a methyl halide to form the desired ester compound. Another way of preparing these compounds is by the direct esterification of the appropriate long chain ethoxylated carboxylic acid together with 2-haloethanol or dimethyl aminoethanol, in the presence of heat and an acid catalyst. The reaction product formed is then quaternized with methylhalide or used to quaternize trimethylamine to form the desired ester compound.

Formulation Criteria

Utilizing the nonionic and cationic components, defined above, preferred compositions of the present invention are formulated using the guidance provided by the Reduced Monomer Concentration ($C_R$) of the cationic component in the laundry solution. Specifically, the selection of a $C_R$ value for a given nonionic and cationic surfactant will determine the ratio in which to combine those surfactants. The Reduced Monomer Concentration of a surfactant is obtained by dividing the concentration of the surfactant monomer present in the laundry solution by the critical micelle concentration (CMC) of the surfactant. As used in this application, CMC's are determined at 105° F. in water containing 7 grains/gallon of mixed hardness, unless otherwise stated. The reduced cationic monomer concentration of the nonionic/cationic surfactant mixture is defined by equations (1) through (3), given below. The nonionic/cationic surfactant mixtures preferred in the present invention are those having reduced monomer concentrations in the range of from about 0.002 to about 0.2, preferably from about 0.002 to about 0.15, and most preferably from about 0.002 to about 0.08. As nonionic and cationic components of greater purity are utilized, the narrower $C_R$ ranges become more preferred.

The concept of reduced monomer concentration, in a single component system, as a quantity which normalizes the extent of adsorption of a surfactant onto a fabric surface (the critical element in the removal of greasy/oily soils) is discussed in Tamamushi and Tamaki, *Proceedings of the Second International Congress of Surface Activity*, III, 449, Academic Press, Inc. (1957). The equations below extend this concept of reduced monomer concentration to multi-component systems, utilizing surfactant monomer concentrations. The concept of surfactant monomer concentration is derived from the discussion in Clint, *J. Chem. Soc. Far. Trans.*, I, 71, 1327 (1975), incorporated herein by reference, in the context of an ideal solution, and is based on the following quadratic equation (equation (11) in Clint):

$$(c_1^m)^2\left[\frac{c_2^*}{c_1^*} - 1\right] + c_1^m(C - c_2^* + c_1^*) - \alpha C c_1^* = 0$$

wherein in the above and the following equations:

C = total analytical surfactant concentration in the solution (moles/l.) = sum of the cationic and nonionic concentrations = $C_1 + C_2$ (wherein "1" denotes nonionic surfactant and "2" denotes cationic surfactant)

$c_1^*$ = critical micelle concentration (CMC) of nonionic surfactant (moles/l.)

$c_2^*$ = critical micelle concentration of cationic surfactant (moles/l.)

$\alpha$ = total mole fraction of nonionic surfactant in the solution = $C_1/(C_1+C_2)$ $\beta$ = a constant based upon the heat of mixing = −2.8

$c_1^m$ = nonionic monomer concentration $c_2^m$ = cationic monomer concentration e = base of Napierian logarithm system = $2.7\overline{1828}$ x = mole fraction of the nonionic surfactant in the micelle at concentration C $f_1$ = nonionic activity coefficient in the mixed micelle = $e^{\beta(1-x)2}$ $f_2$ = cationic activity coefficient in the mixed micelle = $e^{\beta x2}$ $\triangleleft = f_2c_2^* - f_1c_1^*$ $C_R$ = reduced cationic monomer concentration $M_1$ = molecular weight of nonionic surfactant $M_2$ = molecular weight of cationic surfactant W = total analytical surfactant concentration in the solution (ppm) = sum of the cationic and nonionic concentrations (ppm) = $W_1 + W_2$ (wherein "1" denotes nonionic surfactant and "2" denotes cationic surfactant)

Y = weight fraction of nonionic surfactant in the composition

The above equation is solved for the nonionic monomer concentration by taking its positive root (equation (12) in Clint).

$$c_1^m = \frac{\{-(C-(c_2^*-c_1^*))\pm[(C-(c_2^*-c_1^*))^2+4\alpha C(c_2^*-c_1^*)]^{\frac{1}{2}}\}}{2\left(\frac{c_2^*}{c_1^*}-1\right)}$$

By modifying this equation based on the assumptions of a regular, rather than an ideal, solution, the $C_R$ range for optimum performance was derived from the following equation:

$$x = \frac{-(C-\Delta)+\sqrt{(C-\Delta)^2+4\alpha C\Delta}}{2\Delta} \quad (1)$$

For a given cleaning test for a nonionic/cationic system, x was found by inserting the values known from the test (i.e., $c_1^*$, $c_2^*$, $\alpha$, C and $\beta$) into equation (1) and solving iteratively for x, such that the error in x is less than 0.001. This procedure was repeated for a large number of such tests, over varying usage conditions. The x values obtained were then used to solve for the cationic monomer concentrations using the following equation:

$$c_2^m=(1-x)/f_2c_2^* \quad (2)$$

The $C_R$ value was then calculated using equation (3).

$$C_R=c_2^m/c_2^* \quad (3)$$

The $C_R$ values obtained cover a large number of combinations and ratios of various nonionic and cationic surfactants; at various concentrations and temperatures, which have been evaluated for their ability to clean greasy/oily soils. The examination of the resulting data revealed that for a given system the optimum cleaning of greasy/oily soils was found at a $C_R$ value of from about 0.002 to about 0.2.

This range of $C_R$ (i.e., 0.002 to 0.2) can then be used to determine the range of optimum nonionic/cationic ratios for any given combination of nonionic surfactant and cationic surfactant, for the desired wash concentration within the overall wash concentration range of from 100 parts per million (ppm) to 10,000 ppm of surfactant. This calculation is carried out in the following manner, where $\beta$, $C_R$, $c_1^*$, $c_2^*$, $M_1$ and $M_2$ are known for a given nonionic/cationic surfactant pair:

(a) for a given nonionic surfactant, cationic surfactant, and for each end of the $C_R$ range, solve for x using the equation $$(1-x)e^{\beta x^2}=C_R$$

by standard numerical iterative techniques to an error in x of less than 0.001;

(b) find the range of Y from the equation $$\frac{Y(1-x)}{M_1}-\frac{x(1-Y)}{M_2}=\frac{1000}{W}[x(x-1)\Delta]$$

using 100 ppm and 10,000 ppm as the boundary values for W, for each end of the $C_R$ range;

(c) the nonionic/cationic ratio (NCR) range for optimum performance is then within the range obtained by substituting the boundary values for Y into the formula $$NCR=Y/(1-Y)$$

Put another way, steps (b) and (c) may be combined into a single equation which may be solved directly for the NCR.

$$NCR=\frac{Y}{1-Y}=-\frac{(1000/W)\Delta+\frac{1}{M_2(x-1)}}{(1000/W)\Delta+\frac{1}{xM_1}}$$

The above procedure is relevant only to wash solution concentrations above the critical micelle concentration of the nonionic/cationic mixture. For concentrations which are as high as about five times the critical micelle concentration, $C_R$ is essentially independent of concentration. This means that for conventional laundry usage concentrations (e.g., 100 ppm to 10,000 ppm, and especially from about 250 ppm to about 3,000 ppm), the $C_R$ of most commercial cationic/nonionic surfactant mixtures (wherein the cationic component has a CMC of less than about 100 ppm, measured at 105° F. water containing 7 grain/gallon of mixed calcium and magnesium hardness) will be independent of the actual usage concentration, so that using a concentration of about 1,000 ppm in the above calculation will be a satisfactory approximation for the entire range. As used herein, if a concentration range is not specified, the 1,000 ppm $C_R$ is meant.

By way of example, the optimum ratio for grease/oil removal for Composition A of Example I, herein, given $C_R$, is calculated below. For this system, the following values are either known or selected as indicated:

W = 1,000 ppm (selected as representative of usage conditions)

$c_1^*=1.967\times10^{-5}$ ppm $c_2^*=2.1875\times10^{-5}$ ppm $\beta=-2.8$ $M_1=406.7$ $M_2=320$ $C_R=0.0073$ (selected for optimum greasy/oily soil removal performance, but could be any value between 0.002 and 0.2)

Substituting the values for $\beta$ and $C_R$ into equation (a):

$$(1-x)e^{-2.8x2}=0.0073.$$

Solving iteratively for x, it is found that x = 0.922.

Using this value for x, it is found that $f_1=0.983$ $f_2=0.925$ $$\Delta=(0.0925)(2,1875\times10^{-5})-(0.983)(1.967\times10^{-5})=-1.73\times10^{-5}$$

Substituting these values into equation (b), it is found that:

$$\frac{Y(1-0.922)}{406.7}-\frac{0.922(1-Y)}{320}=\frac{1000}{1000}(0.922)(0.922-1)(-1.73\times10^{-5})$$

$$Y=0.938$$

Substituting this value for Y into equation (c), the nonionic/cationic ratio is determined.

$$NCR = \frac{0.938}{1 - 0.938} = 15.1$$

It will be noted that this ratio corresponds to the ratio actually found in Example I, Composition A.

In addition to these reduced cationic monomer criteria, the nonionic/cationic surfactant mixture must satisfy the specific cloud point requirements, given below. The cloud point of the nonionic/cationic mixture (and in preferred embodiments the nonionic/cationic mixture plus any electrolytes present in the composition) falls between about 0° and about 95° C., preferably between about 10° and about 70° C., more preferably between about 20° and about 70° C., especially between about 30° and about 50° C. For cold water detergency, the surfactant mixture should have a cloud point between about 0° and about 25° C. The fact that a composition has a cloud point within these temperatures ranges assures that the composition can be utilized under laundry temperature conditions to achieve outstanding removal of greasy/oily soils. If a composition does not have a cloud point within the temperature range specified, it will not yield the outstanding cleaning of the present invention inside that temperature range. The compositions will exhibit their best grease/oil removal performance when the temperature of the wash solution in which they are used falls within about 20° C., preferably within about 15° C., and most preferably within about 10° C., of the cloud point of the nonionic/cationic surfactant mixture. Put another way, the laundry solution temperature range in which the preferred compositions deliver optimum grease/oil removal lies between the cloud point temperature of the system in the absence of the cationic component, and about 30° C., preferably about 25° C., most preferably about 20° C., above that cloud point temperature.

As used herein, the term "cloud point" means the temperature at which a graph which plots the light scattering intensity of the composition versus wash solution temperature begins to sharply increase to its maximum value, under the following experimental conditions:

The light scattering intensity is measured using a Model VM-12397 Photogoniodiffusometer, manufactured by Societé Francaise d'instruments de controle et d'analyses, France (the instrument being hereinafter referred to as (SOFICA). The SOFICA sample cell and its lid are washed with hot acetone and allowed to dry. The surfactant mixture is made and put into solution with distilled water at a concentration of 1000 ppm. Approximately a 15 ml. sample of the solution is placed into the sample cell, using a syringe with a 0.2$\mu$ nucleopore filter. The syringe needle passes through the sample cell lid, so that the cell interior is not the sample cell lid, so that the cell interior is not exposed to atomospheric dust. The sample is kept in a variable temperature bath, and both the bath and the sample are subject to constant stirring. The bath temperature is heated using the SOFICA's heater and cooled by the addition of ice (heating rate$\approx$1° C./minute); the temperature of the sample is determined by the temperature of the bath. The light scattering (90° angle) intensity of the sample is then determined at various temperatures, using a green filter and no polarizer in the SOFICA.

The preferred nonionic and cationic components used in the present compositions are chosen, combined, and used based on three basic criteria: (1) the final composition must satisfy the cloud point criteria, given above, and should be such that the surfactant mixture cloud point temperature is within about 20° C. of normal wash solution temperatures, (2) the reduced cationic monomer concentration of the surfactant mixture preferably falls within the range dfined above; and (3) the concentration of the detergent composition in the wash solution should be sufficient to give the desired cleaning performance under normal laundering temperatures.

Especially desirable for use in the present invention are biodegradable nonionic surfactants which have relatively low CMCs and low cloud points (i.e., the temperature at which an aqueous solution of the surfactant exhibits turbidity). These surfactants can be used to prepare detergent compositions, laundry solutions of which, at lower temperatures, will form the desired nonionic/cationic mixture cloud point without requiring the addition of other ingredients, such as electrolytes or anionic surfactants. Such detergent compositions make it easier to fulfill the cloud point requirements set forth herein, and yield outstanding removal of greasy and oil soils from fabrics.

In formulating and utilizing the compositions of the present invention, it is preferred, for typical American automatic washing conditions, that the nonionic surfactant, the cationic surfactant, and any additional components be chosen and used in amounts such that the temperature at which the detergent composition in the aqueous laundry solution has a cloud point, as defined above, will be between about 30° C. and 50° C., preferably at about 45° C. Where the compositions are used under different washing conditions, the compositions are formulated such that, at the desired use concentration, they exhibit their cloud point at a temperature which is within about 20° C. of the desired washing temperature. Thus, for example, in Japan (where washing temperatures are generally lower than those used in the United States), the compositions are desirably formulated so as to have their cloud point close to about 15° C.

The cloud point temperature for a given composition in the wash solution depends upon the physical and chemical properties (such as CMC and solubility) of the cationic, nonionic and additional components included in that composition, and may be lowered by increasing the alkyl chain lengths of the nonionic or cationic components, by decreasing the degree of ethoxylation of the nonionic component, or by adding electrolytes, such as phosphates, polyphosphonates, perborates, carbonates, or sulfates, particularly in relatively low amounts (such as from about 1 to about 15% of a given composition). More specifically, it is preferred that the detergent compositions of the present invention, when used in the aqueous laundry solution, have cloud points which fall within about 15° C., preferably within about 10° C., and most preferably within about 5° C., of the temperature of the laundry solution. It has been found that when these laundry solution temperature/cloud point relationships are met, the greasy and oily soil removal capacity of the laundry solution increases dramatically.

Although not intending to be bound by theory, it is believed that when a detergent composition of the present invention is in a laundry solution with oilysoiled fabrics, the cationic component is adsorbed onto the fabric, thereby neutralizing the negative charge on the fabric. This charge neutralization enhances the adsorption of the nonionic surfactant onto the fabric, thereby causing the roll up of the oily soil. The soil is then easily removed by agitation. It is by formulating cationic/nonionic surfactant mixtures which satisfy the cloud point and the preferred reduced cationic monomer concentration requirements that this mechanism, and hence, greasy/oily soil removal, is optimized.

Fatty Amide Component

In a particular embodiment of the present invention the nonionic surfactant/cationic surfactant mixture contains from about 2% to about 25%, preferably from about 2% to about 16%, and most preferably from about 3% to about 10%, of a fatty amide surfactant. Any nonionic surfactant conventionally used in detergent compositions may be used in these compositions; however, preferred compositions contain the nonionic surfactants defined above, in order to maximize the cleaning benefits obtained. These amide surfactants may be used in nonionic/cationic surfactant mixtures having nonionic: cationic ratios of from about 1:1 to about 100:1. When they are used in the compositions of the present invention, the mixtures have nonionic:cationic ratios of from 5.1:1 to about 100:1, preferably from 5.1:1 to about 50:1, more preferably from about 6:1 to about 40:1, particularly from about 6:1 to about 20:1, and must satisfy the cloud point, and preferably satisfy the reduced cationic monomer, characteristics herein. In nonionic/cationic systems, the ratio of the total cationic and nonionic components to the amide component included, is in the range of from about 5:1 to about 50:1, preferably from about 8:1 to about 25:1. These compositions result in excellent particulate soil removal performance, as well as improved soil antiredeposition characteristics, and the development is described in U.S. Patent application Ser. No. 919,340, Cambre, filed of even date, which is a continuation-in-part of U.S. Patent application Ser. No 811,419, Cambre, filed June 29, 1977, both of which are incorporated herein by reference.

Amides useful in these preferred compositions include, but are not limited to, carboxylic acid amides, sulfonic acid amides, phosphonic acid amides, and boronic acid amides. Preferred amides include those having the formulae:

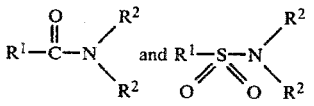

wherein $R^1$is $C_8$ to $C_{20}$ alkyl, alkenyl, alkyl phenyl or alkyl benzyl, preferably $C_{10}$ to $C_{18}$ alkyl, and most preferably $C_{11}$ alkyl; and each $R^2$ is hydrogen, or $C_1$ to $C_8$ alkyl or hydroxyalkyl, preferably hydrogen. Specific examples of these compositions include a mixture of stearoly choline bromide (present in the washing solution at 120 ppm), coconut alcohol polyethoxylate containing an average of 5moles of ethylene oxide (present in the wash solution at about 357 ppm), and a midcut coconutalkyl ammonium amide (present in the wash solution at about 50 ppm); and a mixture of stearoly choline bromide (100 ppm), coconut alcohol polyethoxylate containing an average of 5 moles of ethylene oxide (357ppm), and lauramide ($R^1$ equals $C_{11}$ and $R^2$ is hydrogen; at 45 ppm). These amides may also be used in the surfactant mixtures described in U.S. patent application Ser. No. 919,341, Cockrell, filed of even date and incorporated herein by reference, which have nonionic:cationic ratios of from 5:1 to about 1:1, and preferably have reduced catinic monomer concentrations of from about 0.005 to about 0.2

Additional Components

The compositions of the present invention may also contain additional ingredients generally found in laundry detergent compositions, at their conventional art-established levels. These additional components preferably are selected such that the composition as a whole satisfies the cloud point criteria described above.

The compositions of the present invention may contain up to about 15%, preferably up to about 5%, and most preferably from about 0.1% to 2%, of a suds suppressor component. Typical suds suppressors include long chain fatty acids, such as those described in U.S. Pat. No. 2,954,347, issued Sept. 27, 1960, to St. John, and combinations of certain nonionics therewith, as disclosed in U.S. Pat. No. 2,954,348, issued Sept. 27, 1960, to Schwoeppe, both disclosures being incorporated herein by reference. Other suds suppressor components useful in the compositions of the present invention include, buth are not limited to, those described below.

Preferred silicone suds suppressing additives are described in U.S. Pat. No. 3,933,672, issued Jan. 20, 1976, Bartolotta et al, incorporated herein by reference. The silicone material can be represented by alkylated polysiloxane materials such as silica aerogels and xerogels and hydrophobic silicas of various types. The silicone material can be described as a siloxane having the formula:

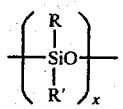

wherein x is from about 20 to about 2,000, and R and R′ are each alkyl or aryl groups, especially methyl, ethyl, propyl, butyl and phenyl. The polydimethylsiloxanes (R and R′ are methyl) having a molecular weight within the range of from about 200 to about 200,000, and higher, are all useful as suds controlling agents. Additional suitable silicone materials wherein the side chain groups R and R′ are alkyl, aryl, or mixed alkyl and aryl hydrocarbyl groups exhibit useful suds controlling properties. Examples of the like ingredients include diethyl-, dipropyl-, dibutyl-, methyl-, ethyl-, phenylmethyl-polysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica, having a particle size in the range from about 10 millimicrons to 20 millimicrons and a specific surface area above about 50 $m^2$/gm., intimately admixed with dimethyl silicone fluid, having a molecular weight in the range from about 500 to about 200,000, at a weight ratio of silicone to silanated silica of from about 19:1 to about 1:2. The silicone suds suppressing agent is advantageously releasably incorporated in a water-soluble or water-dispersible, substantially non-surface-active detergent-impermeable carrier.

Particularly useful suds suppressors are the self-emulsifying silicone suds suppressors, described in U.S. patent application Ser. No. 841,078, Gault et al, filed Oct. 11, 1977, now U.S. Pat. No. 4,136,045 which is a continuation-in-part of U.S. patent application Ser. No. 622,303, filed Oct. 14, 1975, now abandoned, both of which are incorporated herein by reference. An example of such a compound is DB-544, commercially available from Dow Corning, which contains a siloxane/-glycol copolymer together with solid silica and a siloxane resin.

Microcrystalline waxes having a melting point in the range from 35° -115° C. and a saponification value of less than 100 represent additional examples of a preferred suds regulating component for use in the subject compositions, and are described in detail in U.S. Pat. No. 4,056,481, Tate, issued Nov. 1, 1977, incorporated herein by reference. The microcrystalline waxes are substantially water-insoluble, but are water-dispersible in the presence of organic surfactants. Preferred microcrystalline waxes have a melting point from about 65° to 100° C., a molecular weight in the range from 400–1,000; and a penetration value of at least 6, measured at 77° F. by ASTM-D1321. Suitable examples of the above waxes include: microcrystalline and oxidized microcrystalline petrolatum waxes; Fischer-Tropsch and oxidized Fischer-Tropsch waxes; ozokerite; ceresin; montan wax; beeswax; candelilla; and carnauba wax.

Alkyl phosphate esters represent an additional preferred suds suppressant for use herein. These preferred phosphate esters are predominantly monostearyl phosphate which, in addition thereto, can contain di- and tristearyl phosphates; and monooleyl phosphates, which can contain di- and trioleyl phosphates.

The alkyl phosphate esters frequently contain some trialkyl phosphate. Accordingly, a preferred phosphate ester can contain, in addition to the monoalkyl ester, e.g. monostearyl phosphate, up to 50 mole percent of dialkyl phosphate and up to about 5 mole percent of trialkyl phosphate.

The detergent compositions of the present invention may, subject to the limitations on phosphate, discussed above, also include from about 1 to about 60%, preferably low levels of from about 1 to about 15%, of electrolyte components, such as conventional detergency builders, especially alkaline, polyvalent anionic builder salts. The alkaline salts primarily serve to maintain pH of the cleaning solution in the range of from about 7 to about 12, preferably from about 8 to about 11, to modify the cloud point of the detergent composition, and to provide a source of ionic strength. However, it is important to emphasize that the compositions of the present invention are capable of providing excellent cleaning even in the complete absence of such builder materials.

Suitable detergent builder salts useful herein can be of the polyvalent inorganic or polyvalent organic type, or mixtures of these varieties. Nonlimiting examples of suitable water-soluble, inorganic alkaline detergent builder salts include: alkali metal carbonates, borates, phosphates, polyphosphates, bicarbonates, silicates, and sulfates. Specific examples of such salts include sodium and potassium tetraborates, perborates, bicarbonates, carbonates, tripolyphosphates, orthophosphates, pyrophosphates and hexametaphosphates.

Examples of suitable organic alkaline detergency builder salts include: (1) water-soluble aminopolyacetates, for example, sodium and potassium ethylenediamine tetraacetate, nitrilotriacetate, and N-(2-hydroxyethyl)nitrilotriacetates;

(2) water-soluble salts of phytic acid, for example, sodium and potassium phytates; and (3) water-soluble polyphosphonates, including sodium, potassium, and lithium salts of ethane-1-hydroxy-1,1-diphosphonic acid; sodium, potassium, and lithium salts of ethylene diphosphonic acid; and the like.

Additional organic builder salts useful herein include the polycarboxylate materials described in U.S. Pat. No. 3,364,103, incorporated herein by reference, including the water-soluble alkali salts of metallitic acid. The watersoluble salts of polycarboxylate polymers and copolymers, such as those described in U.S. Pat. No. 3,308, 067, incorporated herein by reference, are also suitable as builders herein.

A further class of detergency builder materials useful in the present invention are insoluble sodium aluminosilicates, particularly those described in Belgium Pat. No. 814,874, issued Nov. 12, 1974, incorporated herein by reference. This patent disclosed and claims detergent compositions containing sodium aluminosilicates having the formula $Na_z(AlO_2)_z(SiO_2)_y.XH_2O$, wherein z and y are integers equal to at least 6, the molar ratio of z to y is in the range of from 1.0:1 to about 0.5 1, and X is an integer from about 15 to about 264, said aluminosilicates having a calcium ion exchange capacity of at least 200 milligrams equivalent/gram and a calcium ion exchange rate of at least about 2 grains/gallon/minute/-gram. A preferred material is $Na_{12}(SiO_2.AlO_2)_{12}.27-H_2O$.

Mixtures of organic and/or inorganic builders may be used herein. One such mixture of builders is disclosed in Canadian Pat. No. 755,038 and consists of a ternary mixture of sodium tripolyphosphate, trisodium nitrilotriacetate, and trisodium ethane-1-hydroxy-1,1-diphosphonate.

Other preferred builder materials which may be used in the compositions of the present invention include alkali metal carboxymethyl tartronates, commercially available at about 76% active together with about 7% ditartronate, about 3% diglycolate, about 6% sodium carbonate, and about 8% water; and anhydrous sodium carboxymethyl succinate, commercially available at about 76% active together with about 22.6% water, and a mixture of other organic materials, such as carbonates.

In addition to the cationic and nonionic surfactants discussed above, the detergent compositions of the present invention may additionally contain up to about 50%, preferably from about 1 to about 15%, of anionic surfactants, zwitterionic surfactants, or mixtures of such surfactants. Particularly preferred compositions are those which do not contain anionic surfactant in an amount which exceeds about 25 molar percent of the cationic surfactant. Surfactants of these types useful in the compositions of the present invention are listed in U.S. Pat. No. 3,717,630, Booth, issued Feb. 20, 1973, and U.S. Pat. No. 3,332,880, Kessler et al, issued July 27, 1967, both of which are incorporated herein by reference. Specific nonlimiting examples of surfactants suitable for use in the instant compositions are as follows: These surfactants are selected such that the composition as a whole satisfies the cloud point and reduced cationic monomer concentration criteria described above.

Water-soluble salts of the higher fatty acids, i.e., "soaps", are useful as an anionic surfactant herein. This class of surfactants includes ordinary alkali metal soaps such as sodium, potassium, ammonium, and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soaps.

Another class of anionic surfactant includes water-soluble salts, particularly the alkali metal, ammonium and alkanolammonium salts, or organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic surfactants which can be used in the present detergent compositions are the sodium and potassium alkyl sulfates, especially those obtained by sulfating the higher alcohols ($C_8$–$C_{18}$ carbon atoms) produced by reducing the glycerides of tallow or coconut oil; and sodium and potassium alkylbenzene sulfonates, in which the alkyl group contains from abut 9 to about 15 carbon atoms in straight chain or branched chain configurations, e.g., those of the type described in U.S. Pat. Nos. 2,220,099 and 2,477,383, incorporated herein by reference.

Other anionic surfactant compounds useful herein include the sodium alkyl glyceryl either sulfonates, especially those ethers or higher alcohols derived from tallow and coconut oil; sodium coconut oil fatty acid monoglyceride sulfonates and sulfates; and sodium or potassium salts of alkyl phenol polyethylene oxide ether sulfate containing about 1 to about 10 units of ethylene oxide per molecule and wherein the alkyl groups contain from about 8 to about 12 carbon atoms.

The alkaline earth metal salts of synthetic anionic surfactants are useful in the present invention. In particular, the magnesium salts of linear alkylbenzene sulfonates, in which the alkyl group contains from 9 to about 15, especially 11 to 13, carbon atoms, are useful.

Other useful anionic surfactants herein include the water-soluble salts of esters of alpha-sulfonated fatty acids containing from about 6 to 20 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from abut 1 to 30 moles of ethylene oxide; water-soluble salts of olefin sulfonates containing from about 12 to 24 carbon atoms; and beta-alkyloxy alkane sulfonates containing from about 1 to 3 carbon atoms in the alkyl group and from about 8 to 20 carbon atoms in the alkane moiety.

Preferred water-soluble anionic organic surfactants for use herein linear chain alkylbenzene sulfonates containing from about 10 to 16 carbon atoms in the alkyl group; alkyl sulfates containing from about 10 to 20 carbon atoms; the coconut range alkyl glyceryl sulfonates; and alkyl ether sulfates wherein the alkyl moiety contains from about 10 to 20 carbon atoms and wherein the average degree of ethoxylation varies between about 1 and 6.

Specific preferred anionic surfactants which may be used herein include: sodium linear $C_{10}$–$C_{12}$ alkylbenzene sulfonate; triethanolamine $C_{10}$–$C_{12}$ alkylbenzene sulfonate; sodium tallow alkyl sulfate; sodium coconut alkyl glyceryl ether sulfonate; and the sodium salt of a sulfated condensation product of $C_{14}$–$C_{18}$ alcohol with from about 1 to about 10 moles of ethylene oxide.

It is to be recognized that any of the foregoing anionic surfactants can either be used separately or in mixtures.

Zwitterionic surfactants include derivatives of aliphatic quaternary ammonium, phosphonium, and sulfonium compounds in which the aliphatic moieties can be straight or branch chain, wherein one of the aliphatic substituents contains from about 8 to 18 carbon atoms and one contains anionic water-solubilizing group. Particularly preferred zwitterionic materials are the ethoxylated ammonium sulfonates and sulfates disclosed in U.S. Pat. No. 3,925,262, Laughlin et al, issued Dec. 9, 1975; U.S. Pat. No. 3,929,678, Laughlin et al, issued Dec. 30, 1975; and U.S. Pat. application Ser. No. 849,745, Laughlin et al, filed Nov. 9, 1977, which is a continuation-in-part of U.S. Pat. application Ser. No. 603,837, Laughlin et al, filed Aug. 11, 1975, all of which are incorporated herein by reference. The inclusion of these surfactants in the compositions supplement the excellent greasy and oily soil removal performance with outstanding clay soil removal performance.

Particularly preferred ethoxylated zwitterionic surfactants have the formulae:

$$C_{16}H_{33}-{}^{+}\underset{\underset{CH_3}{|}}{\overset{\overset{CH_3}{|}}{N}}-(C_2H_4O)_9C_2H_4SO_4^-$$

and $$C_{16}H_{33}-{}^{+}\underset{\underset{CH_3}{|}}{\overset{\overset{CH_3}{|}}{N}}-(C_2H_4O)_9C_2H_4SO_3^-$$

The above compounds which contain 8 moles of ethylene oxide are also preferred. Additional preferred zwitterionic surfactants include those having the formula $$C_{16}H_{33}-{}^{+}\underset{\underset{(C_2H_4O)_xH}{|}}{\overset{\overset{CH_3}{|}}{N}}-(C_2H_4O)_yC_2H_4SO_4^-$$

wherein the sum of $x+y$ is equal to about 15.

While the compositions may advantageously contain electrolytes, anionic surfactants and zwitterionic surfactants, as described above, selected so as to satisfy the cloud point requirement, a preferred class of compositions is substantially free of interfering anions, which may interact with the cationic component and thereby hinder cleaning and fabric conditioning performance. What constitutes an "interfering anion" depends upon the nonionic and cationic components contained in a detergent composition, as well as properties of the particular anion, such as structure, bulk and dissociation constant. In these compositions the anionic materials should be contained in amounts sufficiently small such that not more than about 10 molar percent, preferably not more than about 5 molar percent, of the cationic surfactant contained in the laundry solution, is complexed by the anionic material. For example, in preferred compositions, when an anionic material has a dissociation constant of at least about $1\times10^{-3}$ (such as sodium toluene sulfonate) it may be contained in an amount up to about 40%, by weight, of the cationic surfactant; where the anionic material has a dissociation constant of at least about $1\times10^{-5}$, but less than about $1\times10^{-3}$, it may be contained in an amount up to about 15%, by weight, of the cationic surfactant, and where the anionic material has a dissociation constant of less than about $1\times10^{-5}$ (such as sodium $C_{11.8}$ linear alkylbenzene sulfonate), it may be contained only in amounts up to about 10% by weight, of the cationic surfactant. Particularly preferred compositions of this type are those substantially free of phosphate, polyphosphate, silicate, and polycarboxylate builder anions, carboxymethylcellulose, and anionic surfactants.

Other compatible adjunct components which may be included in the compositions of the present invention, in their conventional art-established levels of use, include bleaching agents, bleach activators, soil suspending agents, corrosion inhibitors, dyes, fillers, optical brighteners, germicides, pH adjusting agents, enzymes, enzyme stabilizing agents, perfumes, fabric softening components, static control agents, and the like. Buffers may also be added to control the pH of the compositions, with low molecular weight amino acids, particularly glycine, being preferred where the composition is in the form of a clear liquid. However, because of the numerous and diverse performance advantages of the compositions of the present invention, many components, such as builders, static control agents, fabric softening agents and germicides, generally will not be necessary. The compositions of the present invention may additionally contain monoethanolamine, diethanolamine, or triethanolamine components in amounts up to about 30%, preferably from about 5 to about 20%. These commponents are useful as alkalinity sources and in formulating clear homogeneous liquid products which satisfy the cloud point requirements when placed in an aqueous laundry solution.

Compositions of the present invention may be manufactured and used in a variety of physical forms, such as solid, powder, granular, paste, or liquid. The compositions are particularly well-suited for incorporation into substrate articles for use in the home laundering process. Examples of such articles are described in U.S. patent application Ser. No. 781,378, Flesher et al, filed Mar. 25, 1977; U.S. patent application Ser. No. 781,400, Jones et al, filed Mar. 25, 1977, now U.S. Pat. No. 4,118,525; U.S. patent application Ser. No. 781,399, Jones, filed Mar. 25, 1977; and U.S. patent application Ser. No. 781,385, Hagner et al, filed Mar. 25, 1977, now U.S. Pat. No. 4,113,630, all of the disclosures of which are incorporated herein by reference. These articles consist of a water-insoluble substrate which releaseably incorporates an effective amount, preferably from about 20 to 80 grams of the detergent composition of the present invention. A process of making the compositions of the present invention, particularly suited for use in substrate articles, which includes the intimate and complete mixing together of the nonionic and cationic components, is described in concurrently filed U.S. patent application Ser. No. 919,339. Cockrell et al, which is a continuation-in-part of U.S. patent application Ser. No. 811,418, Cockrell et al, filed June 29, 1977, now abandoned, both of which are incorporated herein by reference. A particularly preferred substrate article incorporates a bleaching component and a bleach activator on the substrate, together with the nonionic/cationic surfactant mixture.

A particularly preferred composition of the present invention is an aqueous heavy-duty liquid laundry composition containing from about 10 to about 50%, preferably about 15 to 40%, of the nonionic surfactant, from about 1 to about 10%, preferably about 1 to 6%, of the cationic surfactant; and which additionally contains from about 5 to about 30%, preferably about 10% of monoethanolamine, diethanolamine, triethanolamine, or mixtures thereof. These compositions may also contain from about 3 to about 20% of an anionic surfactant, particularly one of the ethoxylated or nonethoxylated alkyl sulfate variety. One embodiment of such a composition contains monoethanolamine, coconut trimethylammonium chloride as at least a portion of the cationic component, and a mixture of the condensation product of secondary $C_{12}$ alcohol with an average of 7 moles of ethylene oxide together with the condensation product of secondary $C_{12}$ alcohol with an average of 5 moles of ethylene oxide, in a ratio of higher ethoxylated nonionic to lower ethoxylated nonionic of about 3:1, as the nonionic surfactant. In these compositions, the amounts and ratios of the component may be varied so as to produce a clear, homogeneous product which exhibits the required cloud point characteristics in the aqueous laundry solution.

Laundry Processes

In its broadest aspect, this invention envisions a process for cleaning solid surfaces soiled with greasy and/or oily materials utilizing an aqueous laundry solution comprising from about 0.01% to about 0.3% by weight of a mixture of a nonionic surfactant and a cationic surfactant, wherein the reduced monomer concentration of the cationic surfactant is from about 0.002 to about 0.2, preferably from about 0.002 to about 0.15, and most preferably from about 0.002 to about 0.08; the temperature of the solution being within about 20° C., preferably within about 15° C., more preferably within about 10° C. of the cloud point of the nonionic/cationic surfactant mixture. It is, generally, at the point where the laundry solution temperature is equal to the cloud point that a given system will give its best greasy/oily soil removal performance. Particularly preferred laundry solutions are those in which the ratio of the nonionic surfactant to cationic surfactant is from 5.1:1 to about 100:1, particularly from 5.1:1 to about 50:1, more particularly from about 6:1 to about 40:1, especially from about 6:1 to about 20:1.

Prior to this invention, it was totally unexpected that combinations of nonionic and cationic surfactants, even with a builder present, could provide cleaning of either greasy and oily soils or particulate soils which was competitive with commerical fully-built anionic detergents. Further, there was no indication that reduced cationic monomer concentration and cloud point were critical elements to obtaining removal of greasy and oily soils. It was therefore totally unexpected that such combinations could be used to provide superior performance even in low or non-phosphate systems, as well as in systems containing no builder or relatively non-effective builders.

Such performance is obtained where the newly-discovered cloud point and reduced cationic monomer concentration criteria, set forth herein, are met in the washing process. The process requires that the laundry solution be near the cloud point temperature of the detergent composition, which in general is well above the nonionic's CMC. The cationic surfactant concentration should not be too low or too high above the cationic's CMC for optimal greasy/oily soil removal performance. These criteria and the numerous other constraints set by considerations, such as ecological desirability and safety, help define the preferred compositions set forth herein.

With the process of this invention, it is also possible to achieve superior particulate soil removal if sufficient cationic surfactant is present in the laundry solution. As set forth in the copending application of Cockrell, Ser. No. 919,341, it may be necessary to balance the need for a relatively high concentration of cationic surfactant (e.g., at least about 50 ppm) with other factors and it will be recognized that for very high nonionic:cationic ratios it may not be possible, at present usage concentrations, to achieve the best particulate soil removal. However, the particulate soil removal and greasy/oily soil removal achieved by these processes are superior to that provided by any known commerical detergent while permitting the detergent formulator to meet the ecological and safety concerns of the present day.

In addition to the benefits found in cleaning, the present invention provides an impressive array of secondary, but extremely desirable, benefits which are almost unknown in the conventional anionic detergent compositions and processes of the prior art. For example, depending upon the identity and concentration of the cationic component, it is possible to provide the benefits known in the prior art for such cationics, e.g., antibacterial action, antistatic effects, softening effects for textiles, and an effect not heretofore noted, the prevention or minimization of the transfer of certain dyes from one fabric to another in the cleaning process.

In general, the compositions of the present invention are used in the laundering process by forming an aqueous solution containing from about 0.01 (100 ppm) to 0.3% (3000 ppm), preferably from about 0.02 to 0.2%, most preferably from about 0.03 to about 0.15%, of the nonionic/cationic detergent mixture, within the cloud point and reduced monomer concentration limitations defined above, and agitating the soiled fabrics in that solution. The fabrics are then rinsed and dried. When used in this manner, the compositions of the present invention yield exceptionally good greasy and oily soil removal, as well as particulate soil removal and fabric conditioning performance. When the compositions of the present invention are used in foreign laundry, industrial laundry or hard surface cleaning operations, concentrations as high as about 2% may be used.

All percentages, parts, and ratios used herein are by weight unless otherwise specified.

The following nonlimiting examples illustrate the compositions and method of the present invention.

EXAMPLE I

Two compositions of the present invention were formulated by mixing together the components given below in the amounts specified. The cationic surfactants were chosen so as to be at least water-dispersible when the compositions were used in the laundry solution.

| Component | Wt. % |
|---|---|
| Composition A | |
| $C_{12}$ alcohol polyethoxylate containing an average of 5 moles of ethylene oxide ($C_{12}E_5$) HLB = 11 CMC (determined experimentally, under usage conditions specified herein) = 8 ppm | 93.78 |
| Palmityalkyl trimethylammonium chloride (commercially available as ADOGEN 444) CMC (determined experimentally, under usage conditions specified herein) = 7 ppm | 6.22 |
| Composition B | |
| $C_{12}E_5$ | 53.6 |
| Coconutalkyl trimethylammonium chloride (commercially available as ADOGEN 461) | 6.8 |
| Sodium carbonate | 33.8 |
| Sodium silicate (2.0r) | 5.8 |

Using the equations found in this application, the reduced cationic monomer concentration of Composition A was found to be about 0.0073, and that of Composition B was found to be about 0.023. The cloud point of Composition A is about 45° C., while that of Composition B is about 35° C.

The cleaning performance of these compositions was tested against that of a standard granular detergent composition having the following formulation:

| Component | Wt. % |
|---|---|
| Control 1 | |
| Sodium salt of sulfated tallow alcohol which has been ethoxylated with 3 moles of ethylene oxide | 5.5 |
| Sodium tallow alkyl sulfate | 5.5 |
| Sodium $C_{11.8}$ linear alkylbenzene sulfonate | 7.0 |
| Silicate solids (2.0r) | 12.0 |
| Sodium tripolyphosphate | 24.4 |
| Sodium sulfate | 36.8 |
| Polyethylene glycol 6000 | 0.9 |
| Moisture and minors (e.g., brightener, perfume, etc.) | Balance to 100 |

For each of the above detergent compositions a set of three 11"×11" swatches (one made of double knit polyester, one a 65/35 polyester/cotton blend, and one cotton) were each stained with four separate stains (dirty motor oil, lipstick, triolein, and a clay-in-water suspension). The three swatches were then added to an average six pound load of clean mixed fabrics, containing cotton, polyester, and cotton/polyester fabrics, and the load was washed in a full scale Kenmore washer using on of the compositions described above. Each of the compositions was added to the washing solution at a usage concentration of about 0.1%. Composition A had a pH of 8 in the washing solution, and Composition B had a pH of about 9.7. The wash water was at a temperature of 105° F. (40° C.) and contained 9 grains per gallon of natural hardness. After the laundering was complete, each of the swatches was graded for the removal of each stain on a 1 to 10 scale, with 0 signifying complete removal and 10 signifying no removal at all. For each treatment, the total of the clay removal grades were added up and the total of the grease/oil removal grades were added up. Thus, for each treatment the clay removal score could range from 0, for complete removal, up to 30, for no removal; and for the grease and oil stains, the scores could range from 0, for complete removal, up to 90, for no removal. The results obtained are summarized in the table below.

| Detergent Composition | Grease/Oil Removal | Clay Removal |
|---|---|---|
| Control 1 | 78 | 18 |
| A | 24 | 14 |
| B | 24 | 12 |

These data demonstrate the excellent grease and oil soil removal performance, as well as the excellent particulate soil removal performance, obtained by the use of the compositions of the present invention, even in the absence of any builder components.

Substantially similar results are obtained where the nonionic components in Compositions A and B, above, are replaced by a $C_{14-15}$ alcohol polyethoxylate containing an average of 4 moles of ethylene oxide (HLB=8.9), a $C_{12-13}$ alcohol polyethoxylate containing an average of 6.5 moles of ethylene oxide, a $C_{144-15}$ alcohol polyethoxylate containing an average of 7 moles of ethylene oxide (HLB=11.5), a $C_{12-13}$ alcohol polyethoxylate containing an average of 3 moles of ethylene oxide (HLB=7.9), and the same product which is stripped so as to remove substantially all lower ethoxylate and unethoxylated fractions, a secondary $C_{15}$ alcohol polyethoxylate containing an average of 9 moles of ethylene oxide (HLB=12.7), a coconut alcohol polyethoxylate containing an average of 5 moles of ethylene oxide, a $C_{10}$ alcohol polyethoxylate containing an average of 3 moles of ethylene oxide, a $C_{14}$ alcohol polyethoxylate containing an average of 6 moles of ethylene oxide, a $C_{12}$ alcohol polyethoxylate containing an average of 4 moles of ethylene oxide, a $C_{12-13}$ alcohol polyethoxylate containing an average of 9 moles of ethylene oxide (HLB 13.3), a $C_{14-15}$ alcohol polyethoxylate containing an average of 3 moles of ethylene oxide (HLB=8.9), a $C_{14-15}$ alcohol polyethoxylate containing an average of 9 moles of ethylene oxide (HLB=12.8), and mixtures of those surfactants.

Excellent cleaning results are also obtained where the ratio of nonionic surfactant to cationic surfactant in Compositions A and B, above, are 6:1, 7:1, 9:1, 10:1, 12:1, 17:1, 20:1, or 25:1.

Similar results are also obtained where the sodium carbonate and sodium silicate components of composition B, above, are replaced in whole or in part by other alkali metal tetraborates, perborates, bicarbonates, or carbonates in comparable amounts.

Substantially similar results are also obtained where the cationic surfactants of Compositions A and B are replaced in whole or in part with decylalkyl trimethylammonium chloride, decylalkyl trimethylammonium hydroxide, $C_{14}$ alkyl trimethylammonium chloride, distearylalkyl dimethylammonium chloride, tridecylalkyl methylammonium chloride, a mixture of methyl (1) tallowalkyl amido ethyl (2) tallowalkyl imidazolinium methyl sulfate (VARISOFT 475) together with coconutalkyl trimethylammonium chloride (ADOGEN 461) in a ratio of VARISOFT to ADOGEN of about 1:1, 3:3, 3:1, 2:3, or 1:3; or a mixture of palmitylalkyl trimethylammonium chloride with coconutalkyl trimethylammonium chloride in a ratio of palmityl to coconut compound of about 3:1, 2:1, 1:1, 1:2, or 1:3, or surfactants having the following formulae:

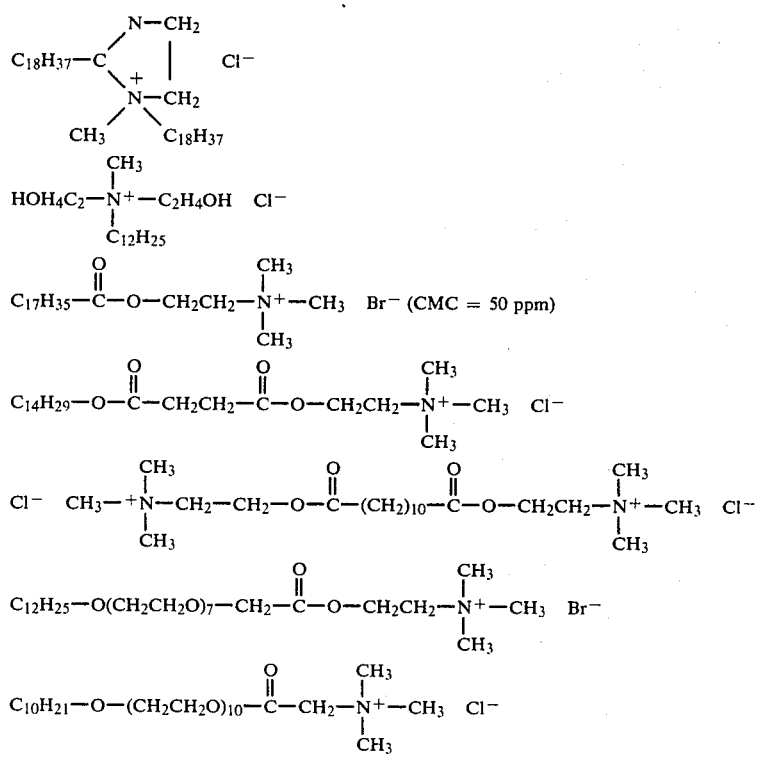

EXAMPLE II

The following two detergent compositions of the present invention were formulated by combining the components described below in the specified amounts. The cationic surfactants were chosen so as to be at least water-dispersible when the compositions were used in the laundry solution.

| Component | Composition C Wt. % | Composition D Wt. % |
|---|---|---|
| $C_{12}E_5$ | 95 | 91 |
| Palmitylalkyl trimethyl-ammonium chloride | 3 | 6 |
| Coconutalkyl trimethyl-ammonium chloride | 2 | 3 |

Composition C had a reduced cationic monomer concentration of about 0.006, and a cloud point of about 45° C., while Composition D had a reduced cationic monomer concentration of about 0.0135, and a cloud point of about 55° C.

The grease/oil and particulate soil removal performance of each composition was then tested using the method described in Example I, above. Both compositions were used at a product concentration of about 0.1% in the washing solution, in water having a temperature of 105° F. (40° C.). Composition C had a pH of 8 and Composition D had a pH of 7.9 in the washing solution. Composition C was used in water containing 7 grains per gallon of natural hardness, while Composition D was used in water containing 7, 14, and 21 grains per gallon of natural hardness. The soil removal performance of these compositions is summarized in the table below.

| Detergent Composition | Hardness (gr/gal.) | Grease/Oil Removal | Clay Removal |
|---|---|---|---|
| C | 7 | 16 | 8 |
| D | 7 | 30 | 7 |
| D | 14 | 22 | 8 |
| D | 21 | 21 | 12 |

The above compositions yielded excellent grease and oil soil removal, as well as particulate soil removal and fabric conditioning benefits, even in the presence of increased concentrations of hardness in the washing solution, without requiring the presence of builder components.

Excellent cleaning results are also obtained where the ratio of nonionic surfactant to cationic surfactant in Compositions C and D, above, are about 10:1, 15:1, 20:1, 25:1, 30:1, 40:1, or 50:1.

EXAMPLE III

Three compositions of the present invention were formulated by combining the components described below in the given amounts and proportions. Each of these detergent compositions, when added to a 105° F. laundry solution appeared turbid, indicating the presence of separated phases in the laundry solution.

| Component | Composition E Wt. % | F Wt. % | G Wt. % |
|---|---|---|---|
| $C_{12}E_5$ | 75 | 90 | — |
| $C_{12-13}$ alcohol polyethoxylate containing an average of 6.5 moles of ethylene oxide ($C_{12-13}E_{6.5}$) | — | — | 80 |
| Coconutalkyl trimethyl ammonium chloride | 4.2 | — | 5 |
| Distearylalkyl dimethylammonium chloride (commercially available as AROSURF TA-100) | — | 10 | — |

-continued

| Component | Composition E Wt. % | F Wt. % | G Wt. % |
|---|---|---|---|
| CMC = 1 ppm | | | |
| Methyl (1) tallowalkyl amido ethyl (2) tallowalkyl imidazolinium methyl sulfate (commercially available as VARISOFT 475) CMC = 8.5 ppm | 4.2 | — | 15 |
| Monoethanolamine | 16.6 | — | — |
| Cloud point (°C.) ≈ | 40° C. | 35° C. | 45° C. |
| Reduced Cationic Monomer Concentration ≈ | 0.011 | 0.0064 | 0.030 |

The grease/oil and particulate soil removal performance of Compositions E, F, and G were then tested against the control composition of Example I using the test method described in Example I, above. All washes were done using water at 105° F. (40° C.), containing 7 grains per gallon of natural hardness. Compositions E, F, and G were used at the usage concentration of about 0.1% in the laundry solution, while the control composition was used at a usage concentration of 0.14%. Composition E had a pH of 10.2 and Composition F had a pH of about 8 in the laundry solution. The soil removal results obtained are summarized in the table below:

| Detergent Composition | Grease/Oil Removal | Clay Removal |
|---|---|---|
| Control 1 | 73 | 14 |
| E | 20 | 8 |
| F | 27 | 7 |
| G | 33 | 7 |

These data demonstrate the outstanding greasy/oily soil removal performance and particulate oil removal performance obtained by using the detergent compositions of the present invention.

EXAMPLE IV

A composition of the present invention was formulated by combining the components given below in the stated proportions.

| Component | Weight % |
|---|---|
| Composition H | |
| $C_{12}E_5$ | 46 |
| Coconutalkyl trimethyl-ammonium chloride | 8 |
| Sodium carbonate | 34.5 |
| Sodium silicate (2.0r) | 11.5 |
| Cloud point ≈ 30° C. | |
| Reduced Cationic Monomer Concentration ≈ 0.037 | |

The soil removal performance of this composition was tested against that of a standard, low-phosphate granular laundry detergent composition having the formulation given below, using the test method described in Example I.

| Component | Weight % |
|---|---|
| Control 2 | |
| Sodium $C_{13}$ linear alkyl benzene sulfonate | 20.0 |
| Silicate solids (2.0r) | 19.5 |
| Sodium carbonate | 20.8 |
| Trisodium sulfosuccinate | 2.0 |

-continued

| Component | Weight % |
|---|---|
| Sodium metaphosphate | 0.4 |
| Sodium sulfate | 31.5 |
| Moisture and minors (e.g., brighteners, perfume, etc.) | Balance to 100 |

Both compositions were added at usage concentrations of 0.14% to the aqueous laundry solution. Composition H had a pH of 9 in the laundry solution. The laundry solution had a temperature of 105° F. (40° C.), and contained 7 grains per gallon of natural hardness. The cleaning results obtained are summarized in the table below.

| Detergent Composition | Grease/Oil Removal | Clay Removal |
|---|---|---|
| Control 2 | 75 | 4 |
| H | 37 | 4 |

These data indicate the outstanding greasy/oily soil removal and particulate soil removal performance which are obtained by using the compositions of the present invention.

EXAMPLE V

The relationship between greasy/oily soil removal performance and cloud point/laundry solution temperature was demonstrated in the following manner. The detergent composition tested was a mixture of the condensation product of $C_{12}$ alcohol with 5 moles of ethylene oxide and $C_{16}$ alkyl trimethylammonium chloride, in a nonionic:cationic ratio of 19:1. The composition was used at a concentration of 1000 ppm in distilled water.

The greasy/oily soil removal performance of this composition was tested, as a function of wash water temperature, using a Tergotometer having one 10 minute wash cycle and two 2 minute rinse cycles. For each test, two b 7.5 cm square desized polyester knit swatches were weighed. The swatches were then stained with 200 mg. technical grade triolein (containing 0.0083% Oil Red-O, for visualization), and weighed again. The swatches were allowed to age for about 2 hours, and were washed in the Tergotometer (1000 ml water; 1000 ppm of the detergent composition), air dried, and reweighed. The percent triolein removal was calculated using the formula: 100×[wt (soiled) - wt (washed)]/[wt (soiled) - wt (clean)]. This procedure was repeated at a series of wash water temperatures.

The lighting scattering intensity of the detergent composition, as a function of solution temperature, was determined as follows.

The light scattering intensity was measured using a Model MV-12397 Photogoniodiffusometer, manufactured by Societé Francaise d'instruments de controle et d'analyses, France (the instrument being hereinafter referred to as SOFICA). The SOFICA sample cell and its lid were washed with hot acetone and allowed to dry. The surfactant mixture was made and put into solution, with distilled water, at a concentration of 1000 ppm. Approximately a 15 ml. sample of the solution was placed into the sample cell, using a syringe with a 0.2μ nucleopore filter. The syringe needle passed through the sample cell lid, so that the cell interior was not exposed to atmospheric dust. The sample was kept in a variable temperature bath, and both the bath and the sample were subject to constant stirring. The bath temperature was heated using the SOFICA's heater and cooled by the addition of ice (heating rate ≈1° C./minute); the temperature of the sample was determined by the temperature of the bath. The light scattering intensity of the sample was then determined at various temperatures, using a green filter and no polarizer in the SOFICA.

The results of these tests are summarized in the following table.

| Temperature (°C.) | % Triolein Removal | Scattering Intensity |
|---|---|---|
| 22 | 52 | 2 |
| 26 | — | 2 |
| 30 | 90 | — |
| 32 | — | 3 |
| 36 | — | 4 |
| 40 | 92 | — |
| 45 | — | 5 |
| 48 | — | 8 |
| 50 | 97 | 13 |
| 52 | — | 16 |
| 56 | — | 25 |
| 58 | — | 35 |
| 60 | 70 | 48 |
| 62 | — | 60 |
| 63 | — | 82 |
| 65 | — | 100 |
| 70 | 58 | — |

These data show that the optimum triolein removal for this detergent composition occurs in a wash solution having a temperature of about 50° C.; this is approximately the same temperature at which the light scattering of the solution begins to sharply increase in moving toward its maximum value (i.e., the cloud point of the nonionic/cationic surfactant mixture). It is therefore seen that by using this detergent composition in a wash solution having a temperature close (i.e., within about 20° C.) to the composition's cloud point, the maximum triolein removal for that composition is achieved.

EXAMPLE VI

A heavy duty liquid laundry detergent composition, having the formula given below, is formulated by mixing together the following components in the stated proportions.

| Component | Wt. % |
|---|---|
| $C_{12}$ alcohol polyethoxylate containing an average of 5 moles of ethylene oxide ($C_{12}E_5$) | 85.15 |
| Palmitylalkyl trimethylammonium chloride | 5.65 |
| Ethanol | 8.0 |
| Water, fluorescer, brightener, perfume and other minors | 1.2 |

This product has a cloud point which falls between 30° C. and 50° C. and when used in an automatic laundering operation at a concentration of about 0.05%, has a pH of about 7.5, and provides excellent removal of both particulate and gready/oil soils.

EXAMPLE VII

A substrate article, for use in the automatic laundering operation, is made by impregnating an 8"×11" sheet of a Scott 8050 Industrial Towel, having an air permeability of about 130 cu.ft./min./sq.ft., a basis weight of about 77.5 grams per sq. yd., and a thickness of 44 mils, with about 50 grams of the composition described in Example VI, above. The sheet is then dried to remove excess moisture. This article provides a convenient method for introducing the compositions of the present invention into the laundering solution, as well as providing excellent cleaning, static control, fabric softening and dye transfer inhibition performance.

A substrate article may also be made by coating one side of an 11"×11" sheet of melt-blown polypropylene, having a thickness of about 29 mils, a basis weight of about 58.5 grams per sq. yd., and an air permeability of about 66 cu.ft./min./sq.ft., with about 60 grams of the detergent composition described in Example VI, placing an identical substrate sheet over the coated sheet, and heat-sealing together the edges of the two substrates, enclosing the detergent composition within the article.

EXAMPLE VIII

A solid particulate detergent composition of the present invention, having the formulation given below, is made in the following manner.

| Component | Wt. % |
|---|---|
| $C_{12}$ alcohol polyethoxylate containing an average of 5 moles of ethylene oxide ($C_{12}E_5$) | 39 |
| Coconutalkyl trimethylammonium chloride | 5 |
| Urea | 25 |
| Sodium carbonate | 15 |
| Sodium silicate (2.0r) | 15 |
| Minors (suds suppressor, brightener, etc.) | Balance to 100 |

The nonionic and cationic components are mixed together, and are then mixed with the solid urea, while concurrently being warmed. The resultant product is then mixed with the carbonate, silicate and minor components. This product, when used in an automatic laundering operation at conventional usage concentrations, has a pH of about 9, and provides excellent particulate and greasy/oily soil removal.

EXAMPLE IX

A solid particulate detergent composition of the present invention, having the formulation given below, is made in the manner described in Example VIII, above.

| Component | Wt. % |
|---|---|
| $C_{12}E_5$ | 39 |
| Coconutalkyl trimethylammonium chloride | 5 |
| Urea | 30 |
| Sodium tripolyphosphate | 15 |
| Minors (suds suppressor, brightener, moisture, etc.) | Balance to 100 |

This product, when used in an automatic washing machine at conventional usage concentrations, has a pH of about 9, and provides excellent particulate and greasy/oily soil removal performance.

EXAMPLE X

A heavy duty liquid laundry detergent composition, having the formula given below, is formulated by mixing together the following components in the stated proportions. The composition, when formulated, has a turbid appearance.

| Component | Wt. % |
|---|---|
| Sodium $C_{13}$ linear alkylbenzene sulfonate | 14.4 |
| $C_{12}E_5$ | 37.4 |
| Coconutalkyl trimethylammonium chloride | 5.8 |
| Sodium sulfate | 13.5 |
| Water and minors (e.g., suds suppressor, perfume, brighteners) | Balance to 100 |

This product, when used in an automatic laundering operation at a concentration of about 0.05%, has a pH of about 9.5, and provides excellent removal of both particulate and greasy/oily soils. The product may also be used as a pretreatment by rubbing it onto greasy/oily soils prior to the laundering operation.

EXAMPLE XI

A heavy duty liquid laundry detergent composition of the present invention, having the formula give below, is formulated by mixing together the following components in the stated proportions.

| Component | Wt. % |
|---|---|
| $C_{12-13}E_{6.5}$ | 50 |
| Tallowalkyl trimethylammonium chloride | 5 |
| Monoethanolamine | 5.5 |
| Ethanol | 5 |
| Sodium chloride | 2 |
| Water and minors | Balance to 100 |

This product, when used in an automatic laundering operation at a concentration of about 0.1%, has a pH of about 10, and provides excellent removal of greasy/oily, body, and particulate soils, as well as providing static control and dye transfer inhibition benefits to the fabrics laundered therewith.

Substantially similar results are obtained where the cationic component is replaced, in whole or part, with palmitylalkyl trimethylammonium chloride, or hydrogenated tallowalkyl trimethylammonium chloride; and the nonionic component is replaced, in whole or part, with the condensation product of $C_{12}$ alcohol with 5 moles of ethylene oxide, the condensation product of $C_{14-15}$ alcohol with 7 moles of ethylene oxide, or mixtures thereof.

EXAMPLE XII

A heavy duty liquid laundry detergent composition, having the formula given below, is formulated by mixing together the following components in the stated proportions. The composition, when formulated, has a clear, homogeneous appearance.

| Component | Wt. % |
|---|---|
| Secondary $C_{12}$ alcohol polyethoxylate containing an average of 7 moles of ethylene | 30 |

-continued

| Component | Wt. % |
|---|---|
| oxide (commercially available as Softanol 70 from Nippon Shokubai Kogyo K.K.) | |
| Secondary $C_{12}$ alcohol polyethoxylate containing an average of 5 moles of ethylene oxide (commercially available as Softanol 50) | 10 |
| Coconutalkyl trimethylammonium chloride | 5 |
| Monoethanolamine | 15 |
| Water and minors | 40 |

This product has a cloud point at about 15° C. and provides excellent removal of particulate, greasy/oily and body soils when used under conventional Japanese laundry conditions, which generally utilize lower water temperatures than do American washing conditions.

EXAMPLE XIII

A heavy duty liquid laundry detergent composition, having the formula given below, is formulated by mixing together the following components in the stated proportions. The composition, when formulated, has a clear, homogeneous appearance.

| Component | Wt. % |
|---|---|
| Secondary $C_{12}$ alcohol polyethoxylate containing an average of 7 moles of ethylene oxide (commercially available as Softanol 70 from Nippon Shokubai Kogyo K.K.) | 30.0 |
| Secondary $C_{12}$ alcohol polyethoxylate containing an average of 5 moles of ethylene oxide (commercially available as Softanol 50) | 10.0 |
| Monoethanolamine | 3.0 |
| Coconutalkyl trimethylammonium chloride | 0.75 |
| Methyl 1-tallowalkylamido ethyl 2-tallowalkyl imidazolinium methyl sulfate | 0.75 |
| Ethanol | 2.0 |
| Suds suppressor | 0.3 |
| Water, brighteners, perfume | Balance |

This product provides excellent removal of particulate, greasy/oily and body soils when used under conventional Japanese laundry conditions, which generally utilize lower water temperatures than do American washing conditions.

EXAMPLE XIV

A heavy duty liquid laundry detergent composition, having the formula given below, is formulated by mixing together the following components in the stated proportions. The composition, when formulated, has a clear, homogeneous appearance.

| Component | Wt. % |
|---|---|
| Secondary $C_{12}$ alcohol polyethoxylate containing an average of 7 moles of ethylene oxide (commercially available as Softanol 70 from Nippon Shokubai Kogyo K.K.) | 15.0 |
| Secondary $C_{12}$ alcohol polyethoxylate containing an average of 5 moles of ethylene oxide (commercially available as Softanol 50) | 5.0 |
| Monoethanolamine | 8.0 |
| Coconutalkyl trimethylammonium chloride | 1.13 |
| Ditallowalkyl dimethylammonium chloride | 0.37 |
| Isopropanol | 1.5 |
| Glycine | 1.5 |
| $C_{12-14}$alkyl dimethyl amine oxide | 10.0 |
| Water and minors (including perfume and dyes) | Balance to 100 |

This product has desirable sudsing characteristics and provides excellent removal of particulate, greasy/oily and body soils when used under conventional Japanese laundry conditions, which generally utilize lower water temperatures than do American laundering conditions.

EXAMPLE XV

A heavy duty liquid laundry detergent composition, having the formula given below, is formulated by mixing together the following components in the stated proportions. The composition, when formulated, has a clear, homogeneous appearance.

| Component | Wt. % |
|---|---|
| Sodium sulfate of $C_{12-15}$ alcohol ethoxylated with 3 moles of ethylene oxide | 5.0 |
| $C_{12-13}$ $E_{6.5}$ | 20.0 |
| Coconutalkyl trimethylammonium chloride | 3.5 |
| Glycine | 8.0 |
| Sodium toluene sulfonate | 10.0 |
| Water and minors | Balance to 100 |

This product has desirable sudsing characteristics and provides excellent removal of particulate, greasy/oily, and body soils when used under conventional Japanese laundry conditions, which generally utilize lower water temperatures than do American laundering conditions.

EXAMPLE XVI

A heavy duty liquid laundry detergent composition, having the formula given below, is formulated by mixing together the following components in the stated proportions.

| Component | Wt. % |
|---|---|
| $C_{12-13}$ alcohol polyethoxylate containing an average of 6.5 moles of ethylene oxide ($C_{12-13}$ $E_{6.5}$) | 42.0 |
| Ditallowalkyl dimethylammonium chloride | 6.0 |
| Ethanol | 10.0 |
| Water, fluorescer, perfume, minors | Balance to 100 |

EXAMPLE XVII

A heavy duty liquid detergent composition, having the formula given hereinafter, was prepared by mixing together the listed components in the stated proportions.

| Component | Wt. % |
|---|---|
| Condensate of $C_{14}$–$C_{15}$ fatty alcohol with an average of 7 moles of ethylene oxide | 28.5 |
| Triethanolamine salt of linear alkylbenzene sulfonic acid wherein the alkyl chain has an average of 11.9 carbon atoms | 20.0 |
| $C_{8-18}$ alkyldihydroxyethyl methyl ammonium chloride | 1.5 |
| Ethanol | 10.0 |
| Diethylenetriamine pentamethylene phosphonic acid | 0.3 |
| Citric acid | 0.2 |
| 9:1 mixture of dimethylpolysiloxane and aerogel silica emulsified in highly ethoxylated fatty acid (commercially available from Dow Corning as DB31) | 0.3 |
| Saturated fatty acid having from 16 to 22 carbon atoms in the alkyl chain | 0.75 |
| Proteolytic enzyme (Maxatase 15% pure enzyme) | 0.4 |
| Minor adjuvants + water | Balance to 100 |

The above composition was homogeneous and storage-stable over prolonged periods of time. In addition, it provided, by reference to prior art compositions, unexpectedly superior greasy stain removal performance.

Substantially similar results are obtained where the cationic component is replaced, in whole or in part, by a comparable level of a quaternized nitrogen-containing ingredient selected from the group consisting of: ditallowalkyl dimethylammonium chloride, methyl-1-tallowalkyl amidoethyl-2-tallowalkyl imidazolinium methyl sulfate, coconutalkyl trimethylammonium chloride, coconutalkyl trimethylammonium bromide, benzyl dihydroxyethylmethylammonium chloride, ethoxylated coconutalkyl quaternary ammonium compounds wherein from 2 to 8 moles of ethylene oxide are condensed onto the nitrogen, and mixtures thereof.

What is claimed is:

1. A detergent composition, having a pH of at least about 6.5 in the aqueous laundry solution, being substantially free of oily hydrocarbon materials and cationic materials containing about 13 or more ethylene oxide groups, and containing from 0 to about 20% phosphate materials, consisting essentially of from about 5% to about 100% of a surfactant mixture consisting essentially of:

(a) a biodegradable nonionic surfactant having the formula $$R(OC_2H_4)_nOH$$

wherein R is a primary or secondary alkyl chain of from about 8 to about 22 carbon atoms and n is an average of from about 2 to about 12, and having an HLB of from about 5 to about 17; and (b) a cationic surfactant, free of hydrazinium groups, having the formula $$R_m^1R_x^2Y_LZ$$

wherein each $R^1$ is an organic group containing a straight or branched alkyl or alkenyl group optionally substituted with up to 3 phenyl or hydroxy groups and optionally interrupted by up to 4 structures selected from the group consisting of

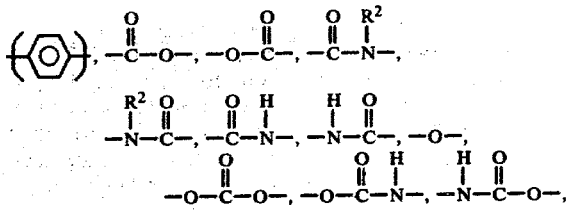

and mixtures thereof, each $R^1$ containing from about 8 to about 22 carbon atoms, and which may additionally contain up to about 12 ethylene oxide groups; m is a number from 1 to 3; each $R^2$ is an alkyl or hydroxy alkyl group containing from 1 to 4 carbon atoms or a benzyl group, with no more than one $R^2$ in a molecule being benzyl; x is from 0 to 11, the remainder of any carbon atom positions being filled by hydrogens; Y is selected from the group consisting of (1)

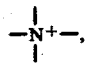

(2)

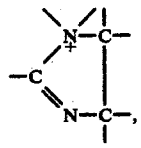

(3)

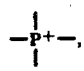

(4)

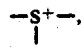

(5)

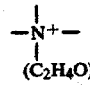

$(C_2H_4O)_pH$, wherein p is from 1 to 12, (6)

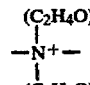

$(C_2H_4O)_pH$, wherein each p is from 1 to 12, (7)

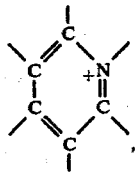

(8)

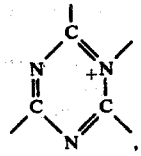

, and

-continued (9) mixtures thereof;

L is 1 or 2, the Y groups being separated by a moiety selected from the group consisting of $R^1$ and $R^2$ analogs having from one to about twenty-two carbon atoms and 2 free carbon single bonds when L is 2; Z is an anion in a number sufficient to give electrical neutrality to the molecule; said cationic surfactant being at least water-dispersible in admixture with said nonionic sufactant;

the ratio of said nonionic surfactant to said cationic surfactant being in the range of from 5.1:1 to about 100:1, and said mixture having a cloud point of from about 0° to about 95° C. and the balance being selected from the group consisting of: up to about 60% of a detergency builder selected from the group consisting of alkali metal carbonates, tetraborates, bicarbonates, perborates, tripolyphosphates, orthosphosphates, pyrophosphates, hexametaphosphates, silicates, and sulfates, organic alkaline detergency builder salts selected from the group consisting of sodium and potassium ethylenediaminetetraacetates, nitrilotriacetates, N-(2-hydroxyethyl)nitrilotriacetates, phytates, ethane-1-hydroxy-1,1-diphosphonates, ethylene diphosphonates, and mellitates and insoluble sodium aluminosilicates having the formula $Na_z(AlO_2)_z(SiO_2)_y.xH_2O$, wherein z and y are integers equal to at least 6, the molar ratio of z to y is in the range of from 1.0:1 to about 0.5:1, and X is an integer from about 15 to about 264, said aluminosilicates having a calcium ion exchange capacity of at least 200 milligrams equivalent/gram and a calcium ion exchange rate of at least about 2 grains/gallon/minute/gram; up to about 30% of sources of alkalinity selected from the group consisting of triethanolamine, diethanolamine and monoethanolamine; up to about 15% of a suds suppressor selected from the group consisting of long chain fatty acids, silicone suds suppressor additives, microcrystalline waxes, and alkyl phosphate esters; water; ethanol; isopropanol; urea; sodium chloride; and up to about 50% by weight of anionic detergents, zwitterionic detergents of mixtures thereof wherein the anionic detergents are selected from the group consisting of: alkali metal, ammonium, alkaline earth metal and alkanolammonium salts of higher fatty acids containing 8 to 24 carbon atoms, organic sulfuric reaction products containing from about 8 to about 22 carbon atoms in an alkyl group, from 0 to 30 ethoxy groups and a sulfonate or sulfate group, and up to about 10% by weight of the cationic surfactant of alkyl benzene sulfonates containing from 9 to 15 carbon atoms in the alkyl group, and wherein the zwitterionic surfactant contains an alkyl group with 8 to 18 carbon atoms, a quaternary ammonium, phosphonium or sulfonium group and wherein one of the substituents bears an anionic water solubilizing group; up to about 40% by weight of sodium toluene sulfonate by weight of the cationic surfactant; and mixtures thereof.

2. The composition according to claim 1 wherein said surfactant mixture has a reduced cationic monomer concentration of from about 0.002 to about 0.2 and wherein said surfactant mixture has a cloud point of from about 10 to about 70° C.

3. A composition according to claim 2 which contains less than about 10% of the cationic surfactant and which is substantially free of fatty acid polyglycol ether diesters and phosphate materials.

4. A composition according to claim 2 wherein the cationic surfactant has a critical micelle concentration of less than about 100 ppm, when measured in 105° F. water containing 7 grains/gallon of mixed hardness.

5. A composition according to claim 2 which may contain anion-producing materials selected from the group consisting of: materials having a dissociation constant of at least about $1\times10^{-3}$, in amounts up to about 40%, by weight, of the cationic surfactant; materials having a dissociation constant of at least about $1\times10^{-5}$ and less than about $1\times10^{-3}$, in amounts up to about 15%, by weight, of the cationic surfactant; and materials having a dissociation constant of less than about $1\times10^{-5}$, in amounts up to about 10%, by weight, of the cationic surfacant.

6. The composition according to claim 2 wherein said surfactant mixture has a reduced cationic monomer concentration of from about 0.002 to about 0.15.

7. The composition according to claim 6 wherein said surfactant mixture has a reduced cationic monomer concentration of from about 0.002 to about 0.08.

8. A composition according to claim 2 wherein L is equal to 1.

9. The composition according to claim 8 wherein said surfactant mixture has a cloud point of from about 20 to about 70° C.

10. A composition according to claim 8 wherein, in the nonionic surfactant, R is a $C_{10}$ to $C_{20}$ alkyl group.

11. A composition according to claim 10 wherein, in the nonionic surfactant, R is a substantially linear alkyl group.

12. A composition according to claim 8 wherein, in the nonionic surfactant, n is from 2 to 9.

13. The composition according to claim 12 wherein said surfactant mixture has a reduced cationic monomer concentration of from about 0.002 to about 0.15.

14. The composition according to claim 13 wherein said surfactant mixture has a reduced cationic monomer concentration of from about 0.002 to 0.08.

15. A composition according to claim 2 which contains from about 10% to about 95% of the surfactant mixture; wherein p is from 1 to 10; wherein Y is selected from the group consisting of

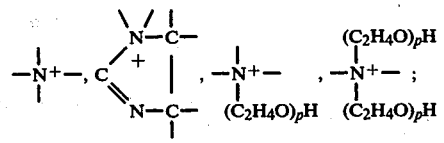

and wherein the ratio of nonionic surfactant to cationic surfactant is from 5.1:1 to about 50:1.

16. A composition according to claim 15 wherein the ratio of nonionic surfactant to cationic surfactant is from 6:1 to about 20:1.

17. A composition according to claim 15 which contains up to about 5% of a suds suppressor component.

18. A composition according to claim 15 which contains from about 1 to about 15% detergency builder materials.

19. A composition according to claim 15 wherein Y is $$-\overset{|}{\underset{|}{N}}{}^{+}-.$$

20. A composition according to claim 19 wherein the cationic surfactant is selected from the group consisting of ditallowalkyldimethylammonium chloride, methyl (1) tallowalkylamidoethyl (2) tallowalkylimidazolinium methyl sulfate, and mixtures thereof.

21. A composition according to claim 19 wherein m is 1, x is 3, and $R^1$ is a $C_{10}$ to $C_{18}$ alkyl group and wherein each $R^1$ is a methyl group.

22. A composition according to claim 21 wherein m is 2, x is 2, each $R^1$ is a $C_{10}$ to $C_{20}$ alkyl group and wherein each $R^2$ is a methyl group.

23. A composition according to claim 15 wherein the nonionic surfactant has an HLB of from about 9 to about 13.

24. A composition according to claim 23 wherein the total number of carbon atoms contained in the $R^1$ and $R^2$ groups of the cationic surfactant is no greater than about 28.

25. A composition according to claim 23 wherein, in the nonionic surfactant, R is secondary alkyl group, and which has a ratio of nonionic surfactant to cationic surfactant of from 5.1:1 to about 15:1.

26. A composition according to claim 23 wheren m is 1, x is 3, and $R^1$ is a $C_{10}$ to $C_{18}$ alkyl group and wherein the nonionic surfactant is selected from the group consisting of $C_{12}$–$C_{13}$ alcohols condensed with 4 to 10 moles of ethylene oxide, $C_{14}$–$C_{15}$ alcohols condensed with 6 to 10 moles of ethylene oxide, and mixtures thereof; and which contains said nonionic surfactant and cationic surfactant in a ratio of from 5.1:1 to about 30:1.

27. A composition according to claim 21 which contains from about 3 to about 20% of an anionic surfactant.

28. A composition according to claim 15 which contains from about 10% to about 50% of the nonionic surfactant, from about 1% to about 10% of the cationic surfactant, and from about 5% to about 30% of a component selected from the group consisting of monoethanolamine, diethanolamine, triethanolamine, and mixtures thereof and wherein the nonionic surfactant is selected from the group consisting of the condensation product of secondary $C_{12}$ alcohol with 7 moles of ethylene oxide, secondary $C_{12}$ alcohol with 5 moles of ethylene oxide, and mixtures thereof.

29. A composition according to claim 29 which contains from about 3 to about 20% of a water-soluble amine oxide surfactant.

30. A process for cleaning solid surfaces soiled with greasy and/or oily soils in which said surfaces are contacted with an aqueous solution consisting essentially of water and from about 0.1% to about 0.3% of the detergent composition of claim 2, the temperature of the solution being within about 20° C. of the cloud point of the nonionic/cationic surfactant mixture contained in said composition.

31. A process according to claim 31 wherein said detergent composition may contain anion-producing materials selected from the group consisting of: materials having a dissociation constant of at least about $1\times10^{-3}$, in amounts up to about 40%, by weight, of the cationic surfactant; materials having a dissociation constant of at least about $1\times10^{-5}$ and less than about $1\times10^{-3}$, in amounts up to about 15%, by weight, of the cationic surfactant; and materials having a dissociation constant of less than about $1\times10^{-5}$, in amounts of up to about 10%, by weight, of the cationic surfactant.

32. A process according to claim 32 wherein, in the cationic surfactant, Y is $$-\overset{|}{\underset{|}{N}}{}^{+}-;$$

wherein the nonionic surfactant has an HLB of from about 9 to about 13; and wherein the ratio of nonionic surfactant to cationic surfactant is from 5.1:1 to about 50:1.

33. A process for cleaning solid surfaces soiled with greasy and/or oily soils in which said surfaces are contacted with an aqueous solution consisting essentially of from about 0.01% to about 0.3% by weight of a mixture of water, a nonionic surfactant and a cationic surfactant, wherein said mixture has a reduced cationic monomer concentration of from about 0.002 to about 0.2, and the temperature of the solution is within about 20° C. of the cloud point of said nonionic/cationic surfactant mixture.

34. A process according to claim 33 wherein the reduced cationic monomer concentration of said mixture is from about 0.002 to about 0.15.

35. A process according to claim 34 wherein the reduced cationic monomer concentration of said mixture is from about 0.002 to about 0.08.

36. A process according to claim 33 wherein the temperature of the solution is within about 15° C. of the cloud point of said nonionic/cationic surfactant mixture.

37. A process according to claim 36 wherein the temperature of said solution is within about 10° C. of the cloud point of said nonionic/cationic surfactant mixture.

* * * * *